US006341984B1

(12) United States Patent
Murakami et al.

(10) Patent No.: US 6,341,984 B1
(45) Date of Patent: Jan. 29, 2002

(54) WATERPROOF PLUG AND WATERPROOF CONNECTOR INCORPORATING THE SAME

(75) Inventors: Takao Murakami; Naoto Taguchi, both of Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/664,387

(22) Filed: Sep. 18, 2000

(30) Foreign Application Priority Data

Sep. 16, 1999 (JP) ..... 11-262469
Sep. 17, 1999 (JP) ..... 11-264512
Sep. 17, 1999 (JP) ..... 11-264524

(51) Int. Cl.[7] ..... H01R 13/40
(52) U.S. Cl. ..... 439/587
(58) Field of Search ..... 439/587, 148, 439/936, 588, 589, 352, 357, 358, 275, 279, 271

(56) References Cited

U.S. PATENT DOCUMENTS 5,165,834 A * 11/1992 Takenouchi et al. ..... 411/542
5,382,174 A * 1/1995 Kinoshita ..... 439/271
5,490,785 A * 2/1996 Hein et al. ..... 439/76.1
5,613,868 A * 3/1997 Ohsumi et al. ..... 439/275
5,630,731 A * 5/1997 Sawada ..... 439/567
5,934,926 A * 8/1999 Gabrisko, Jr. et al. ..... 439/316
5,964,621 A * 10/1999 Wolla et al. ..... 439/595
6,036,553 A * 3/2000 Seko et al. ..... 439/752
6,171,140 B1 * 1/2001 Anbo et al. ..... 439/516
6,190,203 B1 * 2/2001 Murakami et al. ..... 439/587

FOREIGN PATENT DOCUMENTS

JP 62-201480 12/1987 ..... H01R/13/52
JP 3-43972 2/1991 ..... H01R/13/52
JP 9-106852 4/1997 ..... H01R/13/52
JP 9-180810 7/1997 ..... H01R/13/52
JP 9-289057 11/1997 ..... H01R/13/52
JP 10-270118 10/1998 ..... H01R/13/64

* cited by examiner

*Primary Examiner*—Gary Paumen
*Assistant Examiner*—Phuong Nguyen
(74) *Attorney, Agent, or Firm*—Sughrue Mion, PLLC

(57) ABSTRACT

A connector housing includes a plurality of terminal chambers into for respectively accommodating a terminal provided with an electric wire. A mat-shaped rubber plug is attached to a rear end portion of the connector housing. In the rubber plug, recessed portions are formed so as to remain cylindrical protrusions each having a through hole through which the electric wire is inserted. A rear holder is attached to the rear end portion of the connector housing to retain the rubber plug thereat. The rear holder includes projections each configured so as to compress the associated protrusion of the rubber plug in the diameter direction of the electric wire as being inserted into the associated recessed portion of the rubber plug. The rubber plug includes at least one protrusion block formed by integrating adjacent cylindrical protrusions.

11 Claims, 20 Drawing Sheets

WATERPROOF PLUG AND WATERPROOF CONNECTOR INCORPORATING THE SAME

BACKGROUND OF THE INVENTION

The present invention relates to a waterproof connector used for the connection of wire harness mounted in a vehicle, and relates to a waterproof plug used for sealing the inside of the connector while being held between the housing of the waterproof connector and an electric wire of the wire harness.

For a related waterproof connector, at the least, the portion whereat male and female terminals engage with each other must be enclosed within in a waterproof space. However, for a waterproof connector having as a function the electrical detection of the engagement of connectors, a terminal that acts in response to the movement of a locking mechanism is provided inside a connector housing, so that the locking mechanism is also enclosed in a waterproof space. For even if a waterproof connector does not have an engagement detector, when it is employed under adverse conditions, mud or dust may become attached to its locking mechanism and prevent the locking mechanism from being easily released. Thus, for such a waterproof connector, the enclosure of the locking mechanism in a waterproof space is also effective.

However, when a locking mechanism is accommodated inside a waterproof space, a problem also arises concerning the time required to unlock it. That is, since release of the locking mechanism must be affected from outside a waterproof seal that defines the waterproof space, some countermeasure is required that will permit the mechanism to be unlocked under these conditions.

Waterproof connectors with engagement detectors for which such countermeasures are provided are disclosed in Japanese Patent Publications Nos. 9-106852A and 10-270118A.

FIG. 19 is a cross-sectional view of the waterproof connector disclosed in the former publication. In a rear wall of a female connector housing 1*a* through hole 1*b* is formed through which is passed a lock arm 1*d* in which, at its distal end, an engagement hole 1*c* is formed. To enable the lock arm 1*d* to be flexibly inclined, it also penetrates and is supported by a waterproof seal 2 that is fitted into the through hole 1*b*. Riding on the upper portion of the lock arm 1*d* is an arm responsive terminal 3 that urges the lock arm 1*d* down towards a projection 4*a*, formed inside a male connector housing 3 on whose upper face a protrusion 4*b* and two engagement detection terminals 5 are provided.

When the male connector housing 4 is fitted into the female connector housing 1, its distal end closely contacts the outer face of a waterproof seal 6 located in a portion into which the lock arm 1*d* is projected, a tightly closed waterproof space S that is defined by the waterproof seal 2. When the connector housings 1 and 4 are normally engaged, the protrusion 4*b* is fitted into the engagement hole 1*c* in the lock arm 1*d*, while the arm responsive terminal 3 contacts the engagement detection terminals 5 and the engagement state is detected by an external circuit.

To release the lock, the lock arm 1*d* is tilted to the position shown in FIG. 19 by the exertion of a force outside the waterproof space S, i.e., by pushing an external end 1*e* of the lock arm 1*d* that extends outward from the waterproof seal 2. Then, the protrusion 4*b* is disengaged from the hole 1*c* of the lock arm 1*d*, and the connector housings 1 and 4 can be separated, releasing the lock. In this unlocking process, the waterproof seal 2 that defines the portion into which the lock arm 1*d* is inserted permits the tilting of the lock arm 1*d*.

FIG. 20 is a cross-sectional view of a waterproof connector disclosed in the latter publication. In the waterproof connector, a female connector housing 7A comprises: a flexible lock arm 7*c*, which engages a male connector housing 7B when the two connector housings 7A and 7B are normally engaged; and a short-circuit terminal 8A that interacts with the bending of the lock arm 7*c*. The male connector housing 7B comprises a detection terminal 8B, which interacts with the recovery of the lock arm 7*c* when the connector housings 7A and 7B are normally engaged, and contacts the short-circuit terminal 8A.

A seal cover 9, which permits the bending of the lock arm 7*c* and covers its distal end and the short-circuit terminal 8A, is attached to the connector housing 7A. The lock arm 7*c* and the terminals BA and BB are accommodated in the waterproof space S that is defined by the seal cover 9.

The waterproof connectors shown in FIGS. 19 and 20 have the following problem, though the release of the lock arms 1*d* and 7*c* can be performed from the outside of the waterproof seal 2 and the seal cover 9.

Since the waterproof connector in FIG. 19 is to be unlocked by pushing the external end 1*e* of the lock arm 1*d* and by tilting the lock arm 1*d*, the through hole of the waterproof seal 2 must be formed to permit the lock arm 1*d* to be tilted. Therefore, water tends to enter through the penetrating portion. Especially when the penetrating portion is composed of elastic material that will permit tilting, the contact force exerted against the lock arm by the waterproof seal 2 is reduced, and the sealing performance is deteriorated.

For the waterproof connector in FIG. 20, the lock arm 7*c* must be operated through the seal cover 9, so that the operation of the unlocking mechanism is not ideal.

Waterproof connectors are structured to waterproof electric wires connected to the respective terminals inserted by fitting a seal member to each electric wire so as to prevent the entry of water and the like from the outside. Otherwise, a plurality of mat-like seal members are integrally formed with electric wire sealing portions to waterproof the whole electric wire by fitting the mat-like seal members to the rear part of a connector housing. The former seal member is called a separate-type waterproof plug, whereas the latter one is called a mat-type waterproof plug.

Japanese Utility Model Publication No. 62-201480U discloses the former separate-type waterproof plug, which will be described with reference to FIG. 21.

The waterproof plug 61 has an insertion hole 62 for receiving an electric wire W and a cylindrical wall 63 surrounding the insertion hole 62. More specifically, the central hole is used as the insertion hole 62, and the peripheral wall is used as the cylindrical wall 63 in order to form an independent tubular body.

The waterproof plug 61 of this kind is normally formed of rubber material such as silicone rubber and NBR, and is formed by rapping molds with the direction of passing the insertion hole 62 therethrough as a rapping direction. Annular convex portions 64 and 65 are also formed on both outer and inner peripheral faces of the cylindrical wall 63 along a peripheral direction crossing the rapping direction.

As shown in FIG. 22, these annular convex portions 64 and 65 are used to make the waterproof plug 61 stick fast to the inner peripheral wall of the insertion hole 67 of a connector housing 66 and to the outer periphery of the electric wire W when the waterproof plug 61 is held between the inner peripheral wall of the insertion hole 67 and the outer periphery of the electric wire W.

However, an excessive force tends to become applied to the related waterproof plug 61 at the time of rapping the product because the annular convex portions 64 and 65 are provided on both the inner and outer peripheral faces of the cylindrical wall 63.

Therefore, though no serious problem arises when rubber material having a high elastic stress marginal value is employed as before, the use of thermoplastic elastomeric resin (e.g., TPEE) having an elastic stress marginal value lower than that of the rubber material may easily make the product undergo plastic deformation at the time of mold opening, thus resulting in poor dimensional stability.

FIG. 23 is a diagram showing a related waterproof connector disclosed in Japanese Patent Publication No. 343972A, and FIGS. 24A and 24B are diagrams showing a mat-type rubber plug used for the waterproof connector. In FIG. 23, the waterproof connector, which engages another connector, comprises: a male connector housing 71; female terminals 72, retained in a terminal chamber; and a mat-shaped rubber plug 74, so mounted that it close the rear end opening of the connector housing 71.

Formed in the rubber plug 74 are a plurality of insertion holes 75 through which electric wires 73 are passed that extend to the rear to the female terminals 72. As is shown in FIGS. 13A and 13B, cylindrical walls 76 define the respective through holes 75, and an appropriate flexible force exerted by the cylindrical walls 76 closely attaches them to the outer faces of the electric wires 73 that are passed through the through holes 75. An ensured gap 77, described around the cylindrical walls 76, permits the cylindrical walls 76 to freely expand when the electric wires 73 are passed through the through holes 75 to the female terminals 72.

To fabricate the rubber plug 74 of the related waterproof connector, the cylindrical walls 76 are formed separately, and the ensured space 77, which permits the expansion of the cylindrical walls 76, is described obtained around their periphery. Therefore, since the cylindrical walls 76 can expand freely, the terminals 72 can easily be passed through the through holes 75. However, the strength of the seals that are obtained after the terminals 72 have been inserted depends only the flexibility of the independent cylindrical walls 76, since no member is provided to increase their sealing strength.

Further, since the through holes 75 are defined by the independent cylindrical walls 76, as is shown in FIG. 24B, a pitch P must be set for the through holes 75, while for the cylindrical walls 76 a satisfactory thickness H1 and an adequate intervening space H2, in the gap 77 a round the periphery of the cylindrical walls 76, are ensured. As a result, the pitch P is increased, and accordingly, the size of the connector is increased.

SUMMARY OF THE INVENTION

While taking the above problems into account, it is the first objective of the present invention to provide a waterproof connector having a superior sealing function and a preferable unlocking function.

It is the second objective of the present invention to provide a waterproof connector that is compactly made and that provides an improved sealing function.

It is the third objective of the present invention to provide a waterproof plug capable of making plastic deformation hardly producible at the time of rapping and also increasing dimensional stability even in a case where any material having a lower elastic stress marginal value, for example, thermoplastic elastomeric resin is used to form the waterproof plug.

In order to achieve the first object, according to the present invention, there is provided a waterproof connector comprising:

a pair of connector housings to be engaged with each other;

a lock member for locking the connector housings at a position where the connector housings are completely engaged;

a seal member for defining a waterproof space which accommodates the lock member, the seal member having a through hole which communicates inside and out of the waterproof space; and an unlock member sealedly inserted into the through hole so as to be slidable in an insertion direction thereof to unlock the engagement of the housing.

In this configuration, when the unlock member merely slides in the direction in which the waterproof seal is penetrated, the release of the lock member can be affected from outside the waterproof seal. In this case, since the unlock member need only slide in the inserting direction, unlike in the related case wherein tilting is permitted, water is prevented from entering via the through hole in the seal member. Further, since the through hole of the seal member need not be composed of elastic material that will permit tilting, the con tact force exerted by the seal member on the unlock member can be increased, and accordingly, the sealing function enhanced. In addition, since the lock member is moved directly by the unlock member, a precise operation can be easily implemented, unlike the related case: where the lock member is controlled via the seal member.

Preferably, one of the connector housings includes a guide member situated adjacent to the seal member for guiding the slide movement of the unlock member. The seal member is made of a material harder than that of the seal member.

In this configuration, since the guide member along which the unlock member slides is provided for the less elastic member that is adjacent to the seal member, the unlock member can be moved linearly and stably. Thus, the lock member can be precisely and easily released, without compromising the integrity of the seal member.

Preferably, one of the connector housings includes a through hole situated adjacent to the seal member. The seal member includes a cylindrical wall portion surrounding the through hole and fitted with the through hole of the connector housing. The cylindrical wall portion is compressed bet ween an outer periphery of the unlock member and an inner wall of the through hole of the connector housing.

In this configuration the cylindrical wall portion around the through hole of the seal member is compresses by insertion of the unlock member, so that the contact force exerted by the seal member on the connector housing and the unlock member is increased. Therefore, the seal at the portion whereat the unlock member is inserted penetrates can be even more increased.

Preferably, the lack member is a lock arm provided with one of the connector housings, which is flexible between a first position for locking the engagement of the connector housings and a second position for unlocking the engagement. The unlock member slides in the through hole toward inside of the waterproof space to flex the lock arm towards the second position.

In this configuration, since the unlock member slides and flexes the lock arm, the connectors can be unlocked.

Preferably, the sliding direction of the unlock member and the flexing direction of the lock arm is substantially orthogonal. The lock arm is provided with a slant face for converting the sliding movement of the unlock member into the flexing movement of the lock arm, and converting a restoring movement of the lock arm into a slide-back movement of the unlock member.

In this configuration, since the unlock member be slid so that it pushes against the slant face of the lock arm, the lock arm can be flexed until it is perpendicular to the direction in which the unlock member is slid. Therefore, when the lock arm is so formed that it can be freely flexed vertically, the unlock member can be set so it can be slid forward and backward, and when the unlock member is slid from the rear of the connector housing to the front, the lock arm can be released. Further, when the flexed lock arm is to be returned to its original position, the slant face of the lock arm pushes the unlock member in the sliding direction, so that in particular, members such as a spring for urging the unlock member backward need not be provided.

Preferably, the waterproof connector further comprises a terminal for electrically detecting the engagement condition of the connector housings, which is disposed inside of the waterproof space.

In this configuration, since the terminal formed in the waterproof space interact with the lock member accommodated within the same waterproof space, the terminal can be brought into contact or separated in accordance with the action of the lock member, and the engagement state of the connectors can be obtained by electrically detecting the state of the terminal.

Preferably, a distal end of the unlock member, which abuts against the slant face of the lock arm, is rounded for In this configuration, since the distal end of the unlock member is rounded, there is minimal contact between the distal end and the slant face and the sliding movement of the unlock member can be precisely converted into the flexing movement of the lock arm.

Preferably, the slant face includes a groove portion for receiving the distal end of the unlock member.

In this configuration, the distal end of the unlock member always appropriately abuts against the slant face of the lock arm, and does not slide off therefrom.

In order to achieve the second object, according to the present invention, there is provided a waterproof connector comprising:

a connector housing including a plurality of terminal chambers into for respectively accommodating a terminal provided with an electric wire;

a mat-shaped rubber plug attached to a rear end portion of the connector housing, in which recessed portions are formed so as to remain cylindrical protrusions each having a through hole through which the electric wire is inserted; and a rear holder attached to the rear end portion of the connector housing to retain the rubber plug thereat, the rear holder, including projections each configured so as to compress the associated protrusion of the rubber plug in the diameter direction of the electric wire as being inserted into the associated recessed portion of the rubber plug, wherein the rubber plug includes at least one protrusion block formed by integrating adjacent cylindrical protrusions.

In this case, since the adjacent cylindrical protrusions are formed as integrated blocks, and unlike the related art, do not separately define a gap in the vicinity, the pitch between the through holes can be reduced, so that a compact connector can be made.

Preferably, the waterproof connector further comprises:

a provisional retaining member for provisionally retaining the rear holder onto the connector housing such that the projections of the rear holder does not interfere with the associated protrusions of the rubber plug; and a retaining member for securely retaining the rear holder onto the connector housing such that the projections interferes the associated projections.

The electric wires are inserted into the associated through holes of the rubber plug when the rear holder is provisionally retained onto the connector housing. Then the rear holder is securely retained onto the connector housing while compressing the protrusions of the rubber plug by the projections of the rear holder.

In this case, since the rear holder can be temporarily held on the connector housing before the projections of the rear holder are pressed into the recessed portion in the rubber plug, the protrusions in the rubber plug are permitted to expand freely, so that the efficiency of the operation when the terminals are inserted can be improved without the rear holder having to be held in place by hand. Further, since the rear holder can be securely held on the connector housing after the projections of the rear holder have been pressed into the recessed portion of the rubber plug, the state where the rubber plug and the electric wires more closely contact each other can be stably maintained for an extended period of time, and the reliability of the sealing can be enhanced.

In order to achieve the third object, according to the present invention, there is provided a waterproof plug molded by a rapping mold, comprising:

a cylindrical wall portion surrounding a through hole extending in the rapping direction, to which an electric wire is inserted; and an annular convex formed on one of an inner face and an outer face of the cylindrical wall portion so as to extend in a direction perpendicular to the rapping direction, wherein the other one of the inner face and the outer face of the cylindrical wall portion is made straight with regard to the rapping direction.

In this configuration, the mold on the part of straight face is drawn first and then the mold on the part of annular convex is drawn, so that no excessive force is applied to the waterproof plug when the mold on the part of straight face is drawn. When the mold on the part of annular convex is drawn, free deformation is permitted as the opposed side face is released, whereby no excessive force is applied to the waterproof plug at the time of rapping. In other words, no excessive force is applied to the waterproof plug in either case of drawing on the outer face or inner face of the cylindrical wall portion. Therefore, plastic deformation at the time of rapping is preventable even in a case where any material having a low elastic stress marginal value is employed. Thus, dimensional stability can be increased.

Preferably, the plug is provided as an individual cylindrical plug a central hole of which serves as the through hole.

The waterproof plug is of a so-called separate type in which it is inserted separately into the through hole between the electric wire and the housing. In a waterproof plug of this type, dimensional stability can be improved as plastic deformation is preventable at the time of rapping even in a case where the waterproof plug is molded from a material having a low elastic stress marginal value.

Preferably, a plurality of cylindrical portions are formed on a mat-shaped seal member. The annular convex is formed on each inner face of the cylindrical portions.

This waterproof plug is of a so-called mat-type in which the gap between the whole electric wire and the connector housing is sealed by fitting the waterproof plug to the rear end of the connector housing. In a waterproof plug of this type, dimensional stability can be improved as plastic deformation is preventable at the time of rapping even in a case where the waterproof plug is molded from a material having a low elastic stress marginal value.

Preferably, the plug is made of a thermoplastic elastomeric resin.

The thermoplastic elastomeric resin is a material having properties of "thermoplastic resin" simultaneously with "rubber" and by using the thermoplastic elastomeric resin to form the waterproof plug, it is possible to decrease the molding time greatly in comparison with the related rubber materials (e.g., silicone rubber and NBR).

BRIEF DESCRIPTION OF THE DRAWINGS

In the accompanying drawings:

FIGS. 10A and 10B are detailed diagrams showing a X portion shown, in FIG. 6, wherein FIG. 10A is a partially enlarged diagram showing the state wherein a rear holder is held temporarily, and FIG. 10B is a partially enlarged cross-sectional view of the state wherein the rear holder is held securely;

FIGS. 11A and 11B are diagrams showing the structure of a rubber plug used for the waterproof connector, wherein FIG. 11A is a front view and FIG. 11B is a side view;

FIGS. 24A and 24B are diagrams showing the structure of a rubber plug used for the related waterproof connector, wherein FIG. 24A is a cross sectional view and FIG. 24B is a diagram as viewed from an arrow E shown in FIG. 23.

DETAILED DESCRIPTION OF THE PREFERRED EMBODIMENTS

One embodiment of the present invention will now be described while referring to the accompanying drawings.

Figure 1:
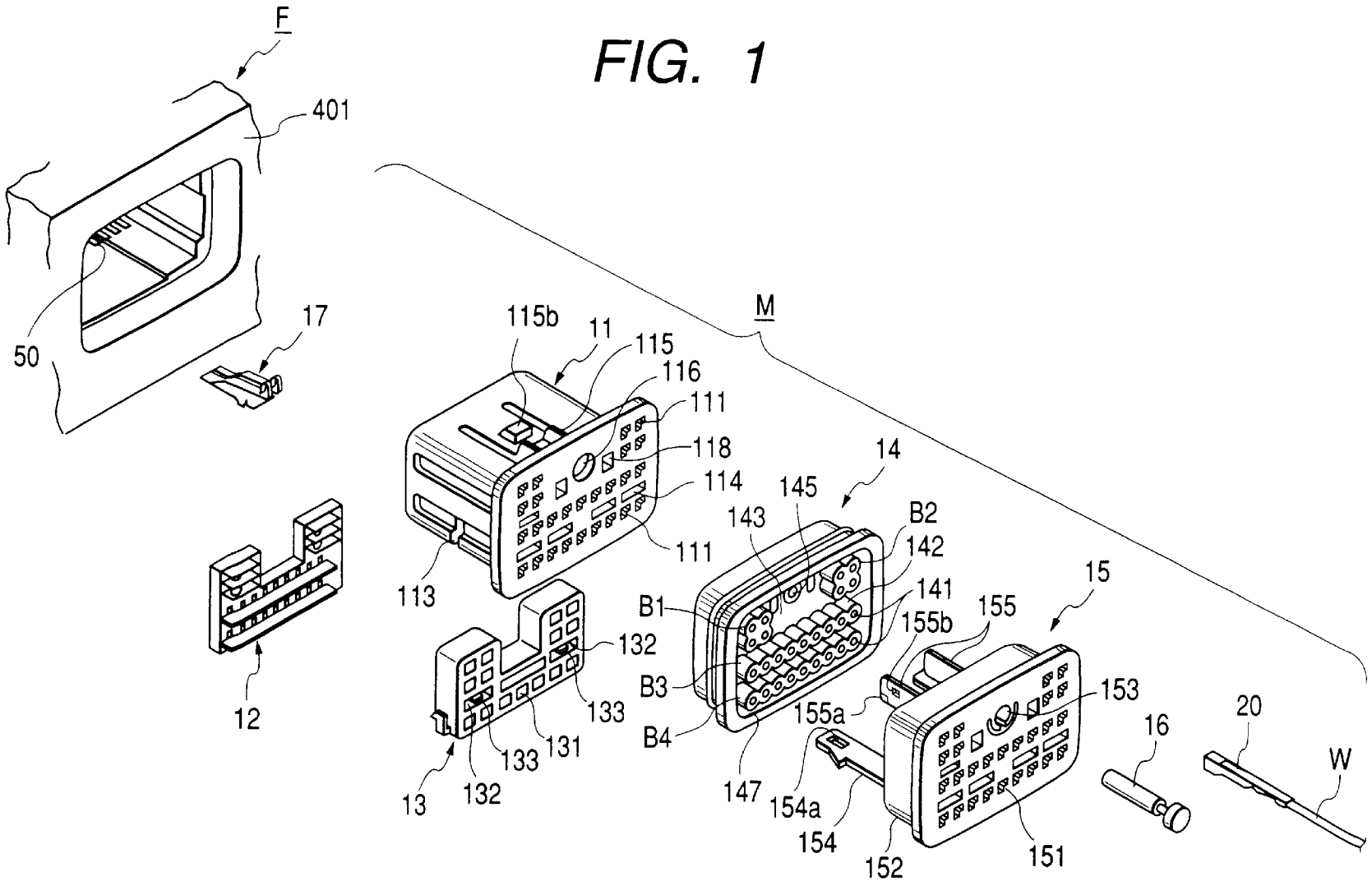
FIG. 1 is an exploded perspective view of a waterproof connector according to-one embodiment of the present invention.

FIG. 1 is an exploded perspective view of a waterproof connector M according to one embodiment of the present invention. The waterproof connector assembly is constituted by a male connector (one connector) M and a female connector (the other connector) F.

The waterproof connector M comprises: a male connector housing 11, which is made of a hard synthetic resin and which includes a plurality of terminal chambers 111; female terminals 20, which are attached to the distal ends of electric wires W and which are inserted into the terminal chambers 111 of the connector housing 11; a spacer 13, which is made of a hard synthetic resin and which is mounted on the lower side of the connector housing 11 to hold the female terminals 20 that are accommodated in the chambers 111; a front cover 12, which is made of a hard synthetic resin and which is mounted on the lower front face of the connector housing 11 to guide male terminals 50 of a mating connector F to the female connectors 20 a mat-shaped rubber plug 14, which includes a plurality of electric wire insertion holes 141, corresponding to the terminal chambers 111, and which is attached to the rear end face of the connector housing 11; and a rear holder 15, which is made of a hard synthetic resin and which presses the mat-shaped rubber plug 14 against the rear face of the connector housing 11. The waterproof connector M also includes: an unlock pin 16, which is used to release locking when the connector M is connected to the mating connector F; and a short-circuit terminal 17, which is used to detect faulty connections.

Figure 2A:
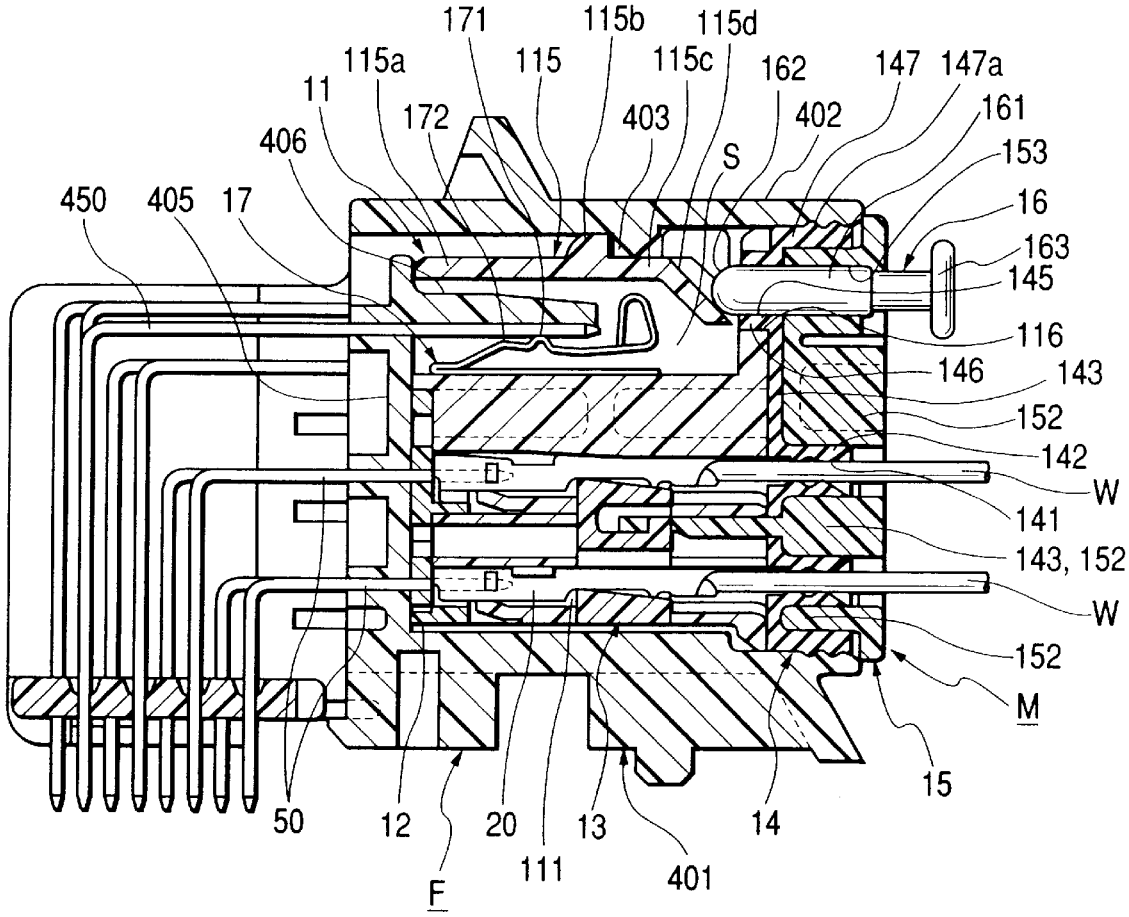
FIG. 2A is a side cross-sectional view of the normal engagement of the waterproof connectors.
Figure 2B:
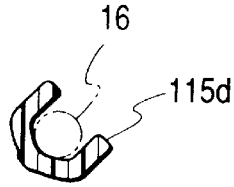
FIG. 2B is a partial cross-sectional view of the essential portion of the waterproof connector.
Figure 3:
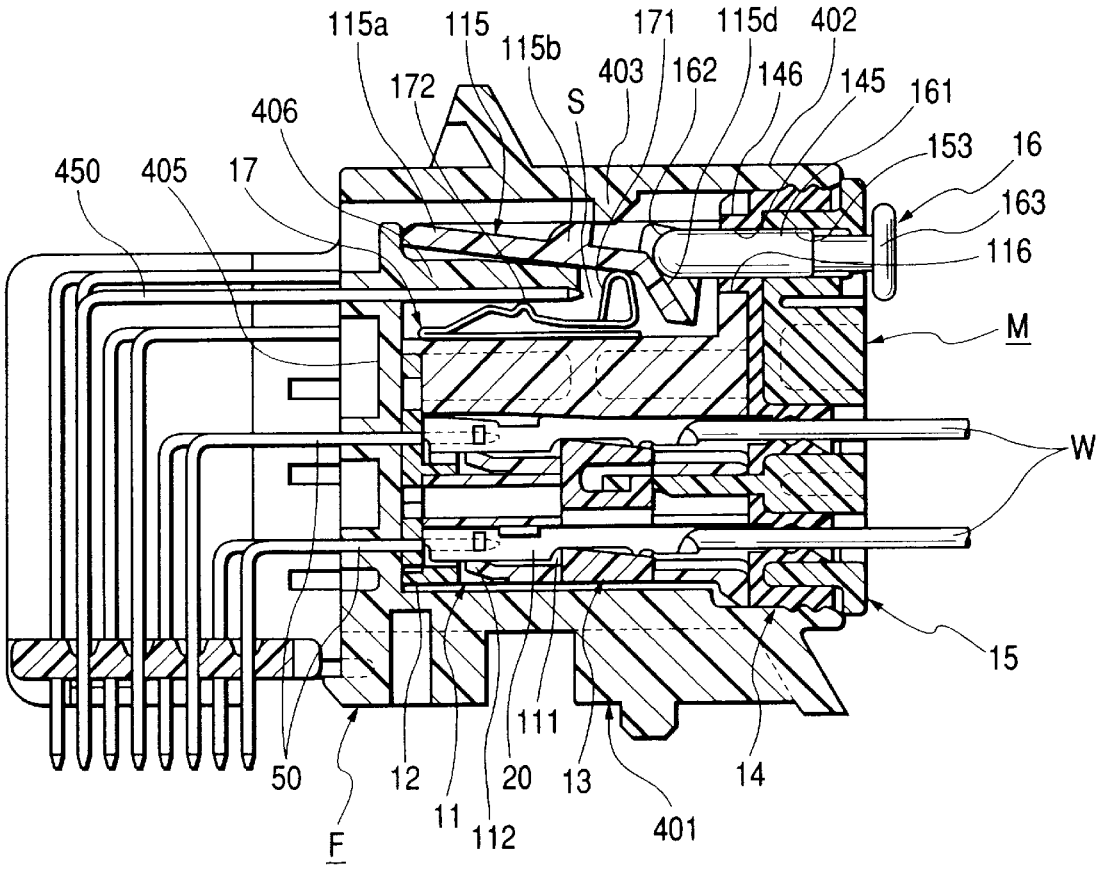
FIG. 3 is a side-cross sectional view of the state the waterproof connectors engaged at the normal engagement position are to be released by pushing an unlocking pin.
Figure 4:
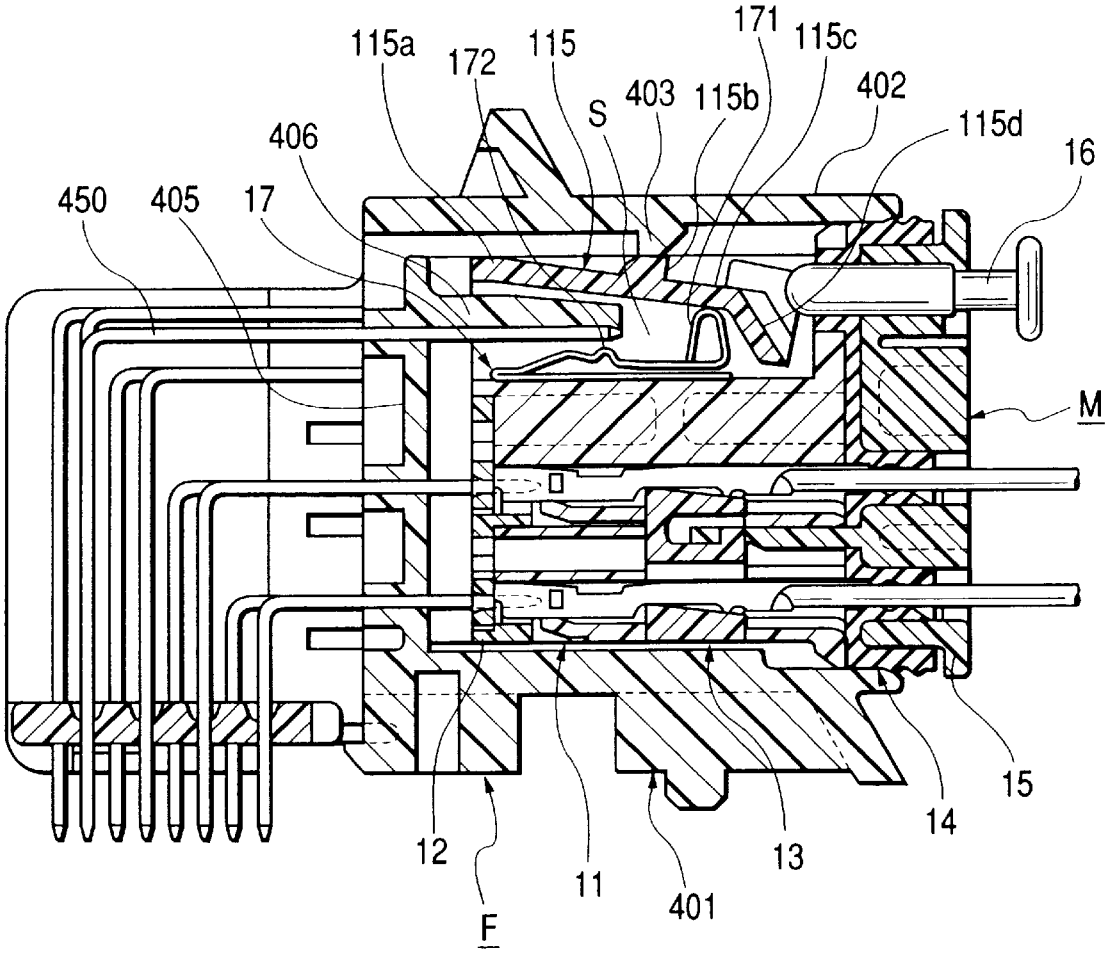
FIG. 4 is a side cross-sectional view of the temporary engagement of the waterproof connectors.

FIG. 2 is a side cross-sectional view of the state wherein the male connector M and the female connector F are engaged at the normal engagement position. FIG. 3 is a side cross-sectional view showing the state wherein the unlocking pin 16 is pushed to disengage the male connector M from the female connector F when they are engaged at the normal engagement. FIG. 4 is a side cross-sectional view of the state wherein the male connector M and the female connector F are temporarily engaged. And FIGS. 5 to 10 are diagrams showing the structure of the male connector M and the assembly procedures, while FIGS. 11 to 14 are diagrams showing the structure of the rubber cap 14 which is a waterproof seal.

First, the male connector M will be described while referring to FIGS. 5 to 14.

Figure 5:
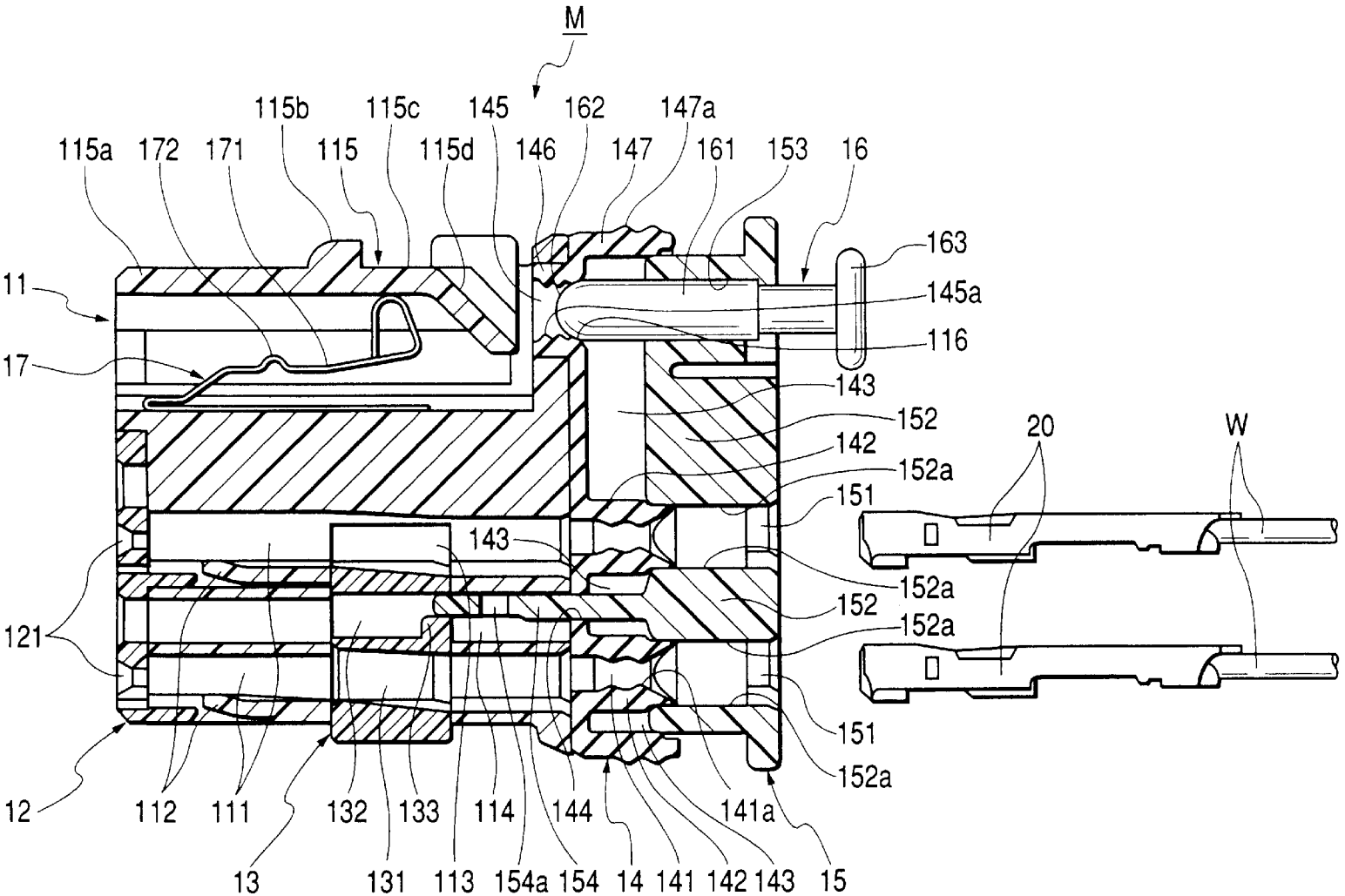
FIG. 5 is a cross-sectional side view of a temporary assembly before the terminals of the waterproof connector of the embodiment are inserted and secured.
Figure 6:
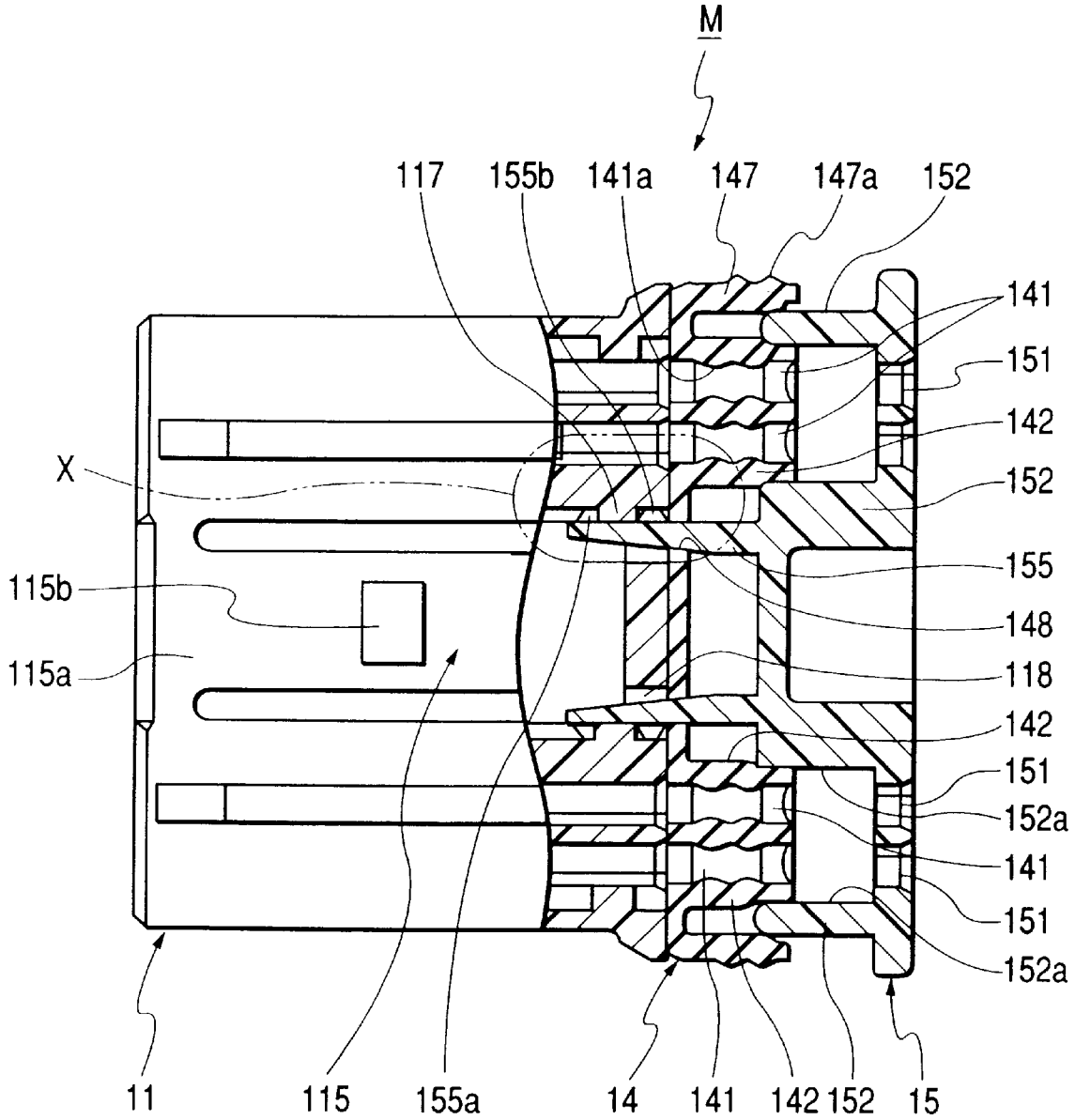
FIG. 6 is a partial cross-sectional plan view of the assembly shown in FIG. 5.

As is shown in FIG. 5, multiple terminal chambers 111 are formed in the connector housing 11 while extending in the front-rear direction thereof, and lances 112, formed on the lower faces of the individual terminal chambers 111, serve as flexible terminal lock arms that prevent the female terminals 20 that are inserted from slipping. Furthermore, as is shown in FIGS. 2 and 3, in order to insert holding arms 154 and 155, which are attached to the rear holder 15 for which a description will be given later, insertion holes 114 and 118 for receiving the holding arms are formed at locations that avoid the terminal chambers 111 in the connector housing 11. A lock arm 115, formed on the upper face of the connector housing 11, locks a connector housing 4 of the mating connector F (see FIG. 1) when the waterproof connector M is connected to the mating connector F. A recessed portion 113 for receiving the spacer 13 is formed in the lower face of the connector housing 11.

A free end 115*c* of the lock arm 115 is extended toward the rear, while a distal fulcrum 115*a* is cantilevered, so that the free end 115*c* is flexibly bent downward, from its constant position, at the distal fulcrum 115*a*. A protrusion 115*b* is formed on the upper face of the lock arm 115 between the distal fulcrum 115*a* and the free end 115*c*. When the connectors M and F engage each other at their normal position, the protrusion 115*b* engages a protrusion (not shown) formed on the connector housing 401 of the mating connector F. An inclined, unlock operating portion 115*d*, having a U-shape in cross section, slopes downward from the free end 115*c* of the lock arm 115. And when the inclined wall of the unlock operating portion 115*d* is contacted from the rear by the distal end of the unlock pin 16, it responds by moving downward, and this movement causes the lock arm 115 bend down in the unlocking direction. As is shown in FIG. 2, when the connectors M and F engage each other at their normal position, the protrusion 115*b* engages a protrusion 403 formed on the hood 402 of the female connector housing 401.

An inclined, unlocking portion 115*d* (an inclined portion), having a U-shape in cross section, slopes downward from the free end 115*c* of the lock arm 115. And when the inclined wall of the unlocking portion 115*d* is contacted from the rear by the distal end of the unlocking pin 16, it responds by moving downward, which causes the lock arm 115 to bend down in the unlocking direction. Further, when the bent lock arm 115 is to be returned to its original position, the unlocking pin 16 can be pushed backward by the action of the inclined wall face.

An unlock pin through hole 116 is formed in the rear wall of the connector housing 11 and extends forward toward the unlock operating portion 115*d* of the lock arm 115. The distal end of a shaft 161 of the unlock pin 16 is inserted into the unlock pin through hole 116. At the distal end of the shaft of the unlock pin 16 is formed a semi-spherical portion 162, which can be brought into contact with the inclined unlock operating portion 115*d* of the lock arm 115.

The unlocking pin 16 is formed with its axial direction extending to the front and to the rear, and can freely slide forward and backward, perpendicular to the vertical direction in which the free end 115*c* of the lock arm 115 is bent.

The short-circuit terminal 17 is stored in the space below the lock arm 115. Provided for the short-circuit terminal 17 is a spring 171, so that the short-circuit terminal 17 can interact with the bending of the lock arm 115, and projecting from the upper face of the spring 171 is a contact point 172. The short-circuit terminal 17 is one component of a mechanism that electrically detects the engagement of the waterproof connector M and the mating connector F.

That is, as is shown in FIG. 2, when the male waterproof connector M and the female connector F are engaged at the normal engagement-position, the two engagement detection terminals 450 of the female connector F contact the contact point 172, and the engagement detection terminals 450 are short-circuited. Further, as is shown in FIG. 4, when the male connector M and the female connector F are not fully engaged, due to the interference of the protrusions 403 and 115, the spring 171 is pushed downward by the lock arm 115, which is bent downward. As a result, the contact point 172 does not contact the engagement detection terminals 450, and the engagement detection terminals 450 are not short-circuited. Therefore, an external examination can be conducted to determine whether the engagement detection terminals 450 have been short-circuited and whether the connectors M and F are fully or only partially engaged. The short-circuit terminal 17 is thus a required component of the pertinent mechanism.

The front cover 12 is mounted on the lower front face of the connector housing 11. Guide holes 121 formed in the front cover 12 guide the male terminals 50 (see FIG. 1) that are inserted. The spacer 13 is inserted into the recessed portion 113 that is provided in the lower face of the connector housing 1.

The spacer 13 is used together with the lances 112 to double-lock the terminals 20 that are inserted and accommodated in the terminal chambers 111. When the spacer 13 is located at the temporary holding position in FIG. 2, the insertion of the terminals 20 is permitted. But when the spacer 13 is pushed in until it occupies the secure holding position in FIG. 9, the spacer 13 and the lances 112 together double-lock the terminals 20.

Through holes 131 for receiving the terminals 20 are formed in the spacer 13 correspond to the terminal chambers 111 of the connector housing 11. There is also formed holes 132 for receiving the lower holding arms (which will be described later) of the rear holder 15 in the spacer 13. Protrusions 133 are formed on the inner bottom faces of the lower holding arm insertion holes 132, and when the spacer is pushed up into the security holding position, the protrusions 133 engage holes 154*a* in the holding arms 154 so as to securely lock the rear holder 15 in the constant position. The engagement holes 154*a* and the protrusions 133 constitute one member for securely locking the rear holder 15.

The mat-shaped rubber plug 14 is mounted on the rear wall of the connector housing 11 as the waterproof seal, and is sandwiched between the connector housing 11 and the rear holder 15 that is provided at the rear. The material that can be used for the rubber plug 14 is not limited to rubber, and another flexible material can be employed for the cap 14. For example, the cap 14 also may be formed of a soft resin.

As is shown in FIGS. 11 to 14, multiple insertion holes 141 are formed in the mat-shaped rubber plug 14 so as to correspond to the terminal chambers 111. Also formed therein are a through hole 145, into which the unlock pin 16 is inserted while forming a waterproof seal, and through holes 144 and,148, into which the holding arms 154 and 155 of the rear holder 15 are inserted while forming a waterproof seal.

Figure 14:
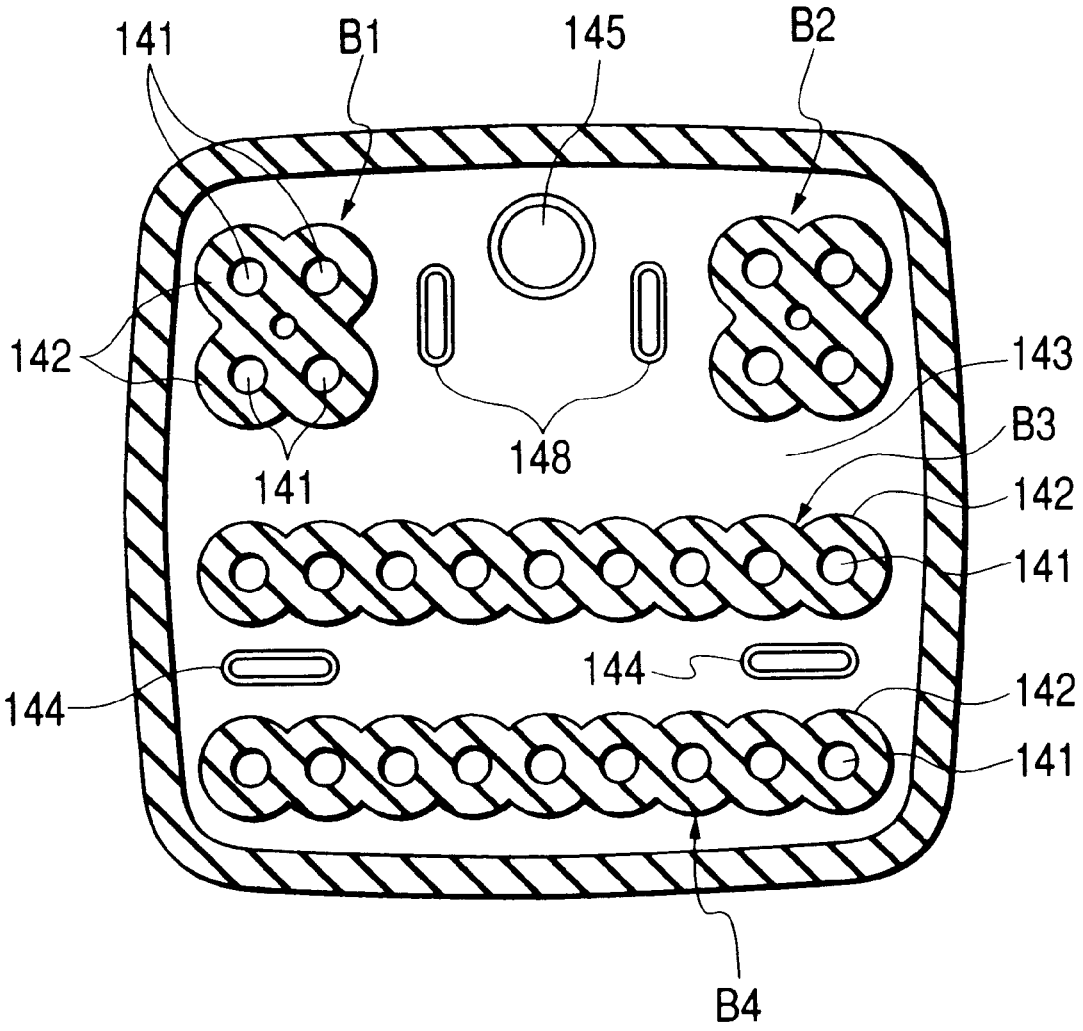
FIG. 14 is a cross-sectional view taken along a line XIV—XIV in FIG. 13.

A recessed portion 143 is formed in the rear face of the rubber plug 14, while cylindrical walls 142 are left around the individual electric wire insertion holes 141. The outer circumference of the recessed portion 143 is defined by an outer peripheral wall 147, which is as tall as the cylindrical walls 142. As is shown in FIG. 2, when the male connector M is fitted into the. female connector F, the outer peripheral wall 147 is closely sealed with the inner face of the hood 402 of the female connector housing F. When the adjacent cylindrical walls 12 are connected together to form blocks, as is shown in FIG. 14, four blocks B1 to B4 are formed. First, the cylindrical walls 142 around the four insertion holes 141 that are located at the vertexes of a square are connected together to form the first block B1 and the second block B2. Similarly, the cylindrical walls 142, around the insertion holes 141 that are arranged in a single row, are connected together to form the third block B3 and the fourth block B4.

The through hole 145, into which the unlock pin 16 is inserted, and through holes 144 and 148, into which the holding arms 154 and 155 of the rear holder 15 are inserted, are located at positions that avoid the blocks B1 to B4.

Figure 12:
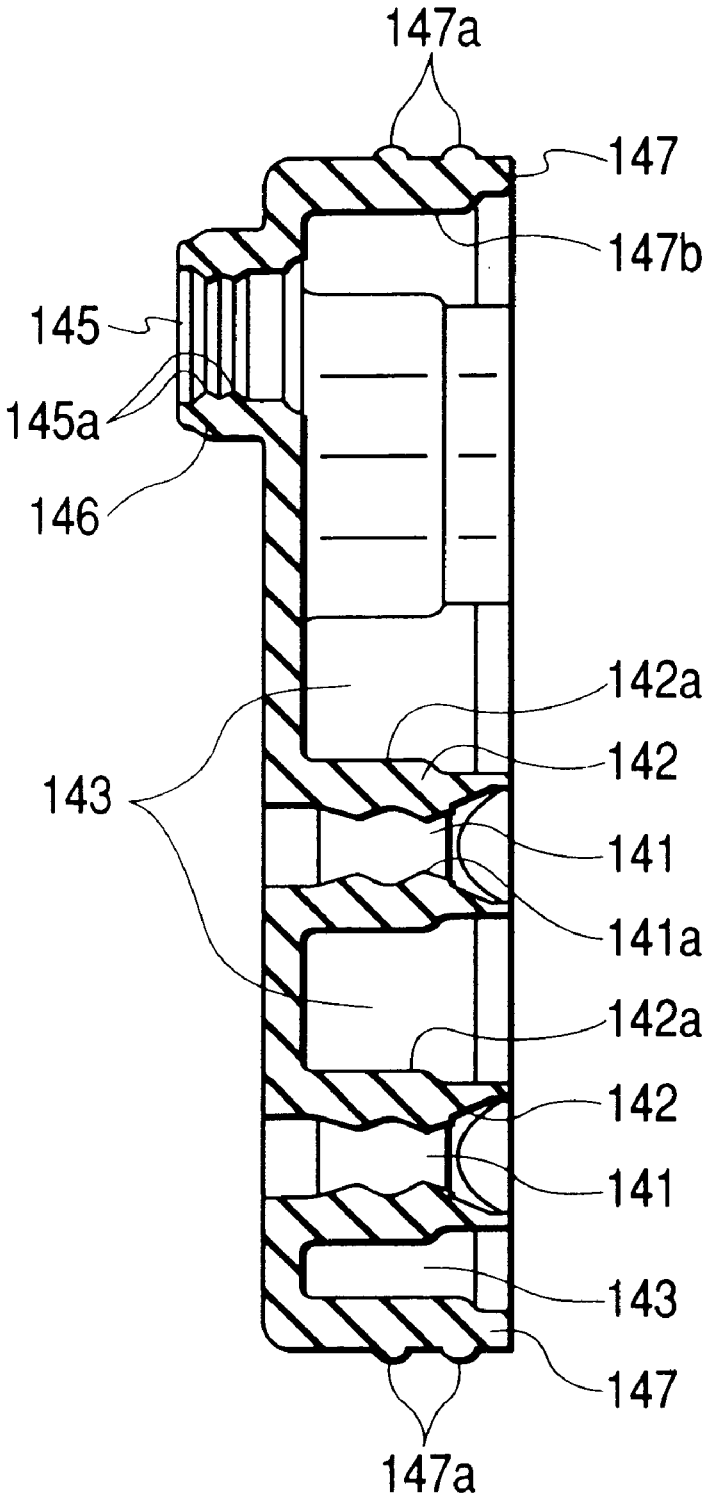
FIG. 12 is a cross-sectional view taken along a line XII—XII in FIG. 11.
Figure 13:
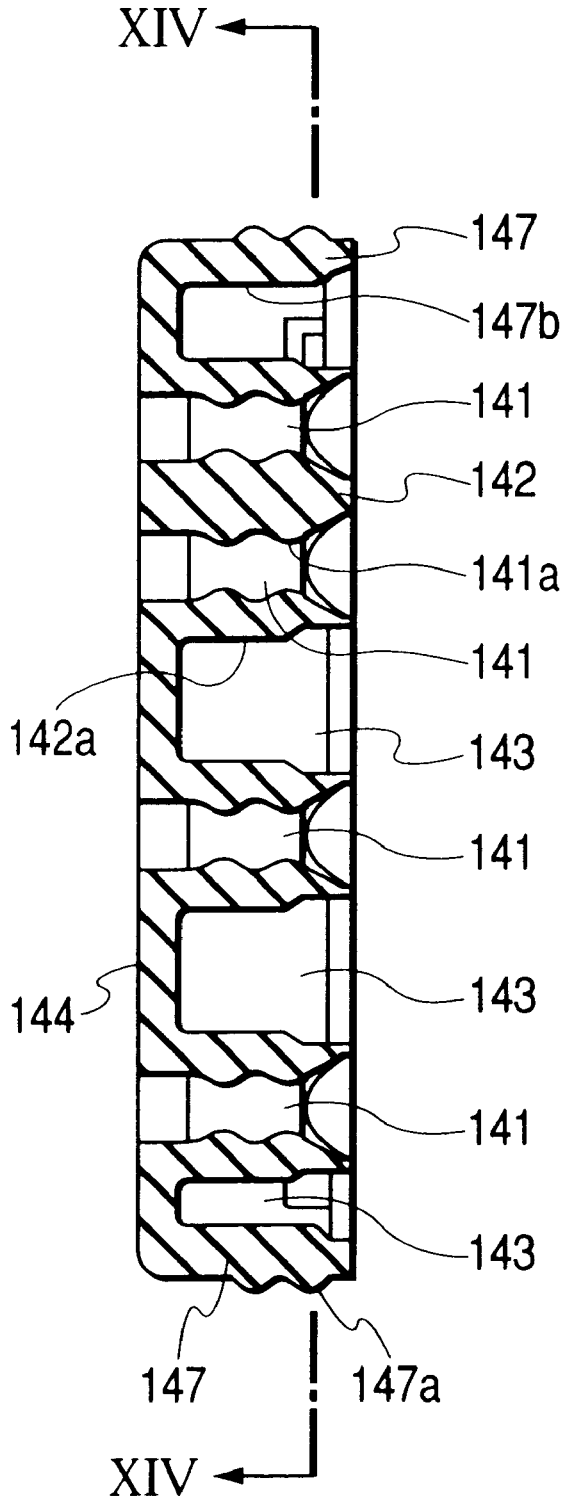
FIG. 13 is a cross-sectional view taken along a line XIII—XIII in FIG. 11.

As is shown in FIGS. 12 and 13, on each of the inner faces of the insertion holes 141, which are enclosed by the cylindrical walls 142, annular convex portions 141*a* having a waveform shape in cross section are arranged at two stages in the direction in which the insertion holes 141 extend, so that the contact force relative to the electric wires W is increased. Similarly, on the outer face of the outer peripheral wall 147, which defines the recessed portion 143, ring-shaped recessed portions 147*a* having a waveform shape in cross section are arranged at two stages in order to increase the contact force relative to the connector housing 401 when the connectors M and F are engaged. In addition, a squeeze 142*a* and a squeeze 147*b* (portions expanded slightly outward) are formed at the base side of the outer face of each cylindrical wall 142 and the inner face of the outer peripheral wall 147, respectively. They are squeezed when a raised portion 152 (which will be described later) on the rear holder 15 is pressed into the recessed portion 143.

A cylindrical wall 146 for the unlock pin 16 is formed around the through through hole 145 that is formed in the rubber plug 14. The cylindrical wall 146 projects outward through the front face of the rubber plug 14, so that it can be fitted into the through hole 116 in the connector housing 11. On the inner face of the cylindrical wall 146, annular convex portions 145*a* are formed at two stages in order to increase the force with which the outer face of the shaft 161 of the unlock pin 16 is contacted.

The waterproof plug 14 is formed by rapping molds with the direction of passing the insertion holes 141 and 145 therethrough as a rapping direction.

The above-described annular convex portions 141*a*, 145*a* and 147*a* formed on the inner peripheral faces of the cylindrical walls 142 and 146 or the outer peripheral face of the outer peripheral wall 147 are formed in a direction crossing the rapping direction. Therefore, the formation of annular convex portions on the face opposite to where the annular convex portions 141*a*, 145*a* and 147*a* may result in developing the same problem as before at the time of drawing.

The straight face is formed as a face opposite to the face on which the annular convex portions 141*a*, 145*a* and 147*a* are formed and instead squeezes 142*a*, 146*a* and 147*b* to press are secured by slightly increasing the wall thickness of the face.

More specifically, on the base side of the outer peripheral face of the cylindrical wall 142 around the insertion hole 141 for the electric wire W, there is provided the squeeze 142*a* that is pressed when the raised portion 152 of the rear holder 15 is press-fitted into the recess 143. On the base side of the outer peripheral face of the cylindrical wall 146 around the through hole 145 for the unlock pin 16, there is also provided the squeeze 146*a* that is pressed when the unlock pin 16 is inserted into the cylindrical-wall 146 while the cylindrical wall 146 is fifted into the through hole 116 of the connector housing 11. On the base side of the inner peripheral face of the outer peripheral wall 147, further, there is provided the squeeze 147*b* that is pressed when the raised portion 152 of the rear holder 15 is press-fitted into the recess 143.

Although the portions where the squeezes 142*a*, 146*a* and 147*b* are provided respectively have the annular convex portions 141*a*, 145*a* and 147*a* on their opposite sides, these portions are formed with the straight faces and consequently hardly subjected to plastic deformation at the time of rapping as in the previous embodiments of the invention, so that dimensional stability is readily maintained.

In the rear holder 15 that presses the rubber plug 14 against the connector housing 11, insertion holes 151 are formed so that they to correspond to the insertion holes 141 in the rubber plug 14. On the front face of the rear holder 15, the raised portion 152 is formed that is fitted into the recessed portion 143 of the rubber plug 14. The walls of the raised portion 152 that interferes with the cylindrical walls 142 and the outer peripheral wall 147 serve as pressing walls (assist walls) 152*a* that press the. squeezes 142*a* and 147*b* on the rubber plug 14. While the squeezes 142*a* and on the cylindrical walls 142 and the squeeze 147*b* are pressed by the assist walls 152*a*, the raised portion 152 is pressed into the recessed portion 143. As a result, the compressive force produced by the electric wire insertion-holes 141 and exerted in the direction of the diameter can act on the cylindrical walls 142, and the backup force acting from the inner side to the outer side can be provided for the outer peripheral wall 147.

Furthermore, a through hole 153, through which the unlock pin 16 is inserted, is formed in the rear holder 15, so that when the shaft 161 of the unlock pin 16 is inserted via the through hole 153, it slides freely in the insertion direction. And at the head of the unlock pin 16, a disk-shaped operating portion 163 is formed for applying finger pressure.

Figure 7:
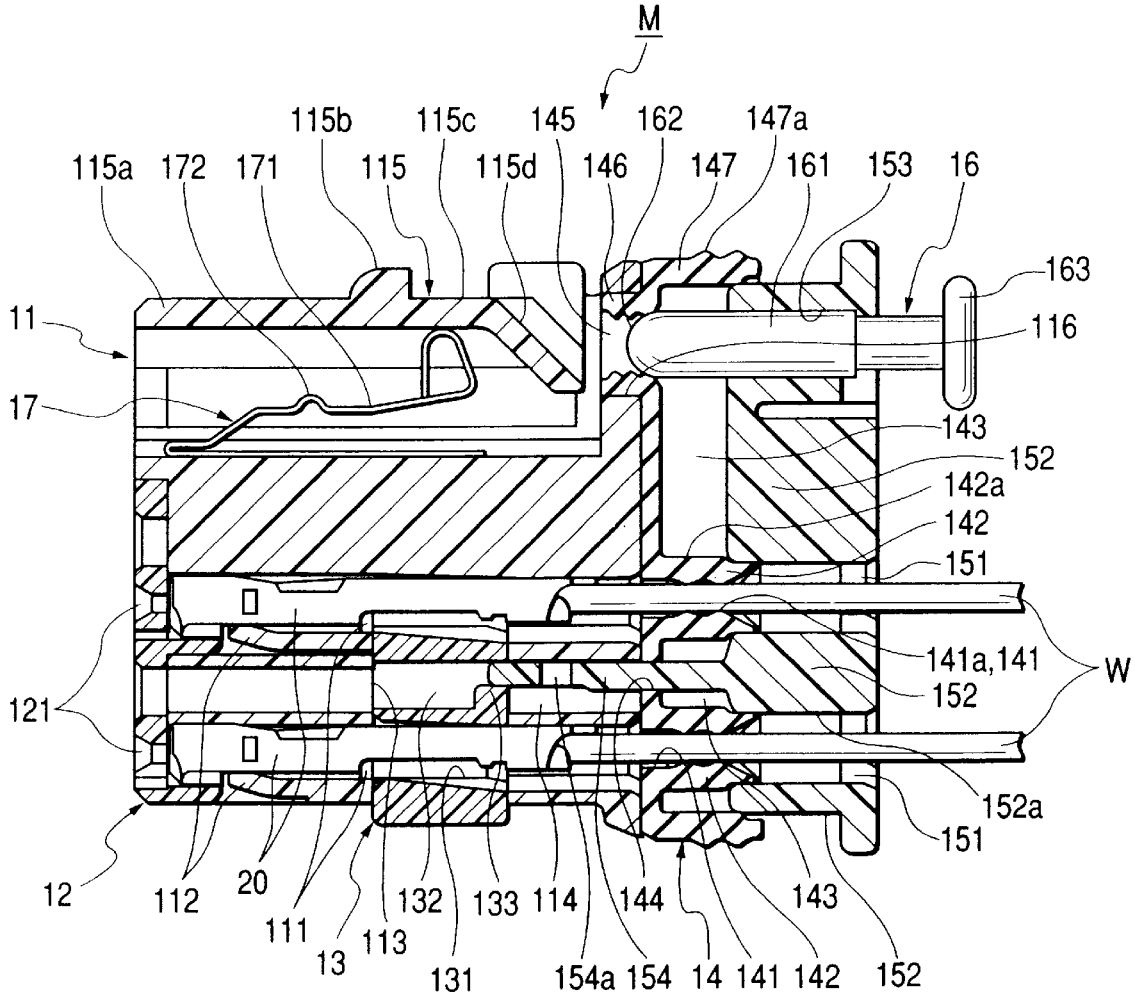
FIG. 7 is a cross-sectional side view for explaining the assembly process for the waterproof connector, and shows the state immediately after the terminals have been inserted.

The lower holding arms 154 shown in FIG. 5 and the upper holding arms 155 shown in FIGS. 3 and 7 projected outward from the front face of the rear holder 15. The lower holding arms 154 include the engagement holes 154*a* into which the protrusions 133 of the spacer 13 are fitted, while the upper holding arms 155 each include a first protrusion 155*a* and a second protrusion 155*b* that selectively engage a protrusion 117 on the connector housing 11.

Figure 10A:
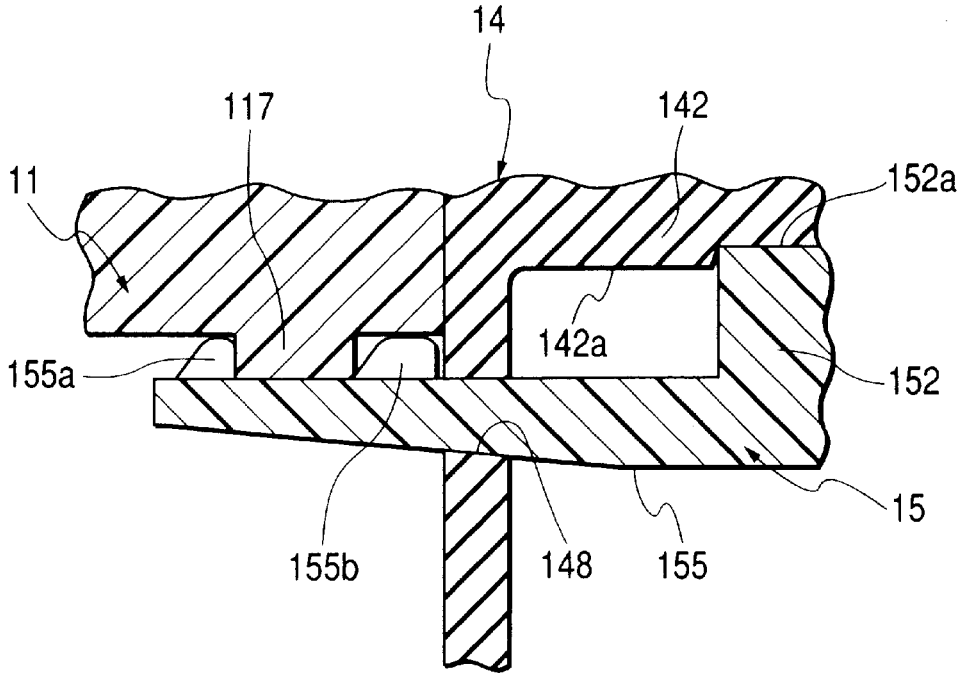

Further, as is shown in FIG. 10A, when the first protrusion 155*a* is located in front of the protrusion 117 and the second protrusion 155*b* is located at the rear of the protrusion 117, the rear holder 15 is temporarily halted, and as is shown in FIG. 2, the raised portion 152 has not yet been fitted into the recessed portion 143 of the rubber plug 14.

Figure 8:
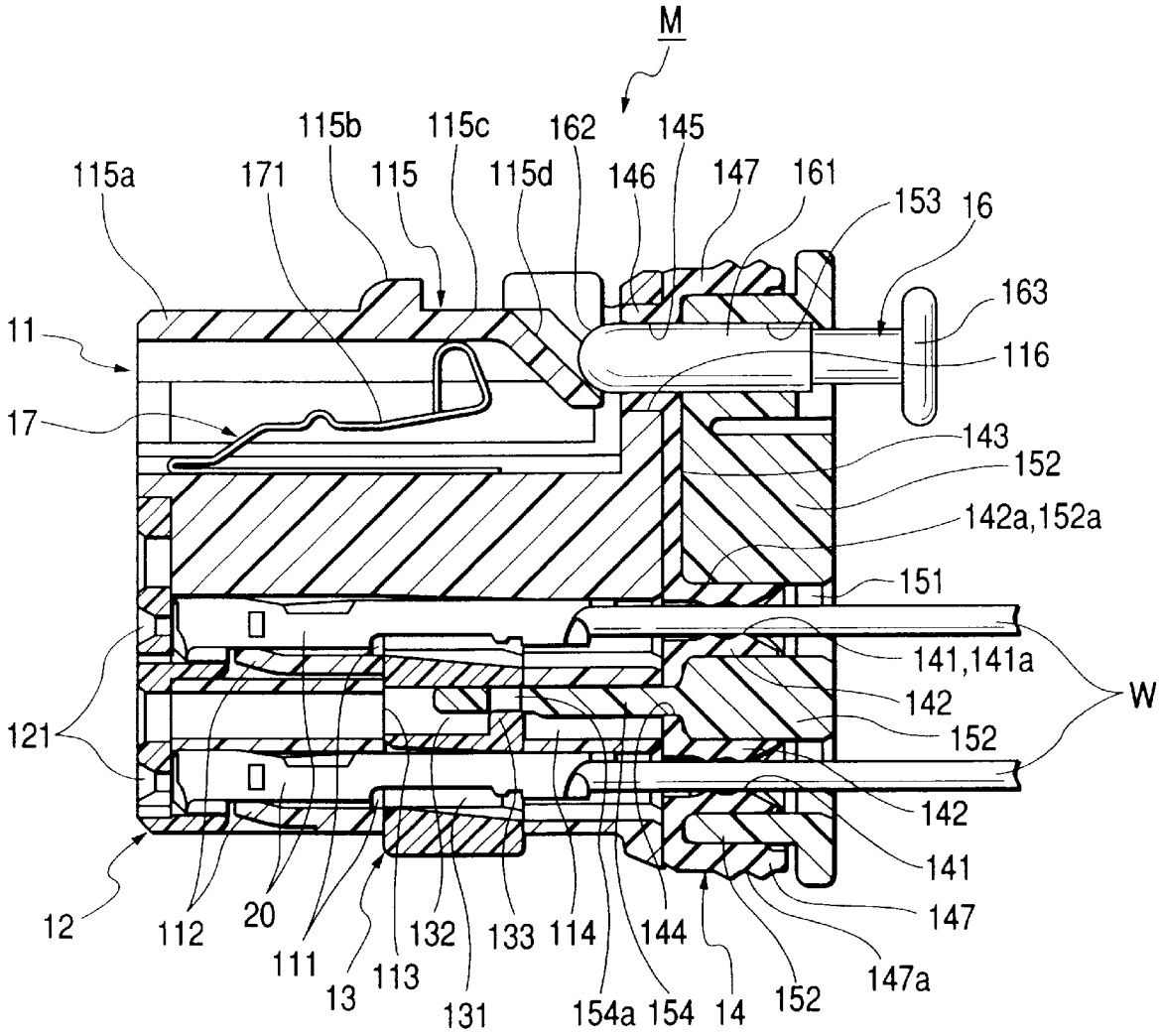
FIG. 8 is a cross-sectional side view of the next step following FIG. 7.
Figure 9:
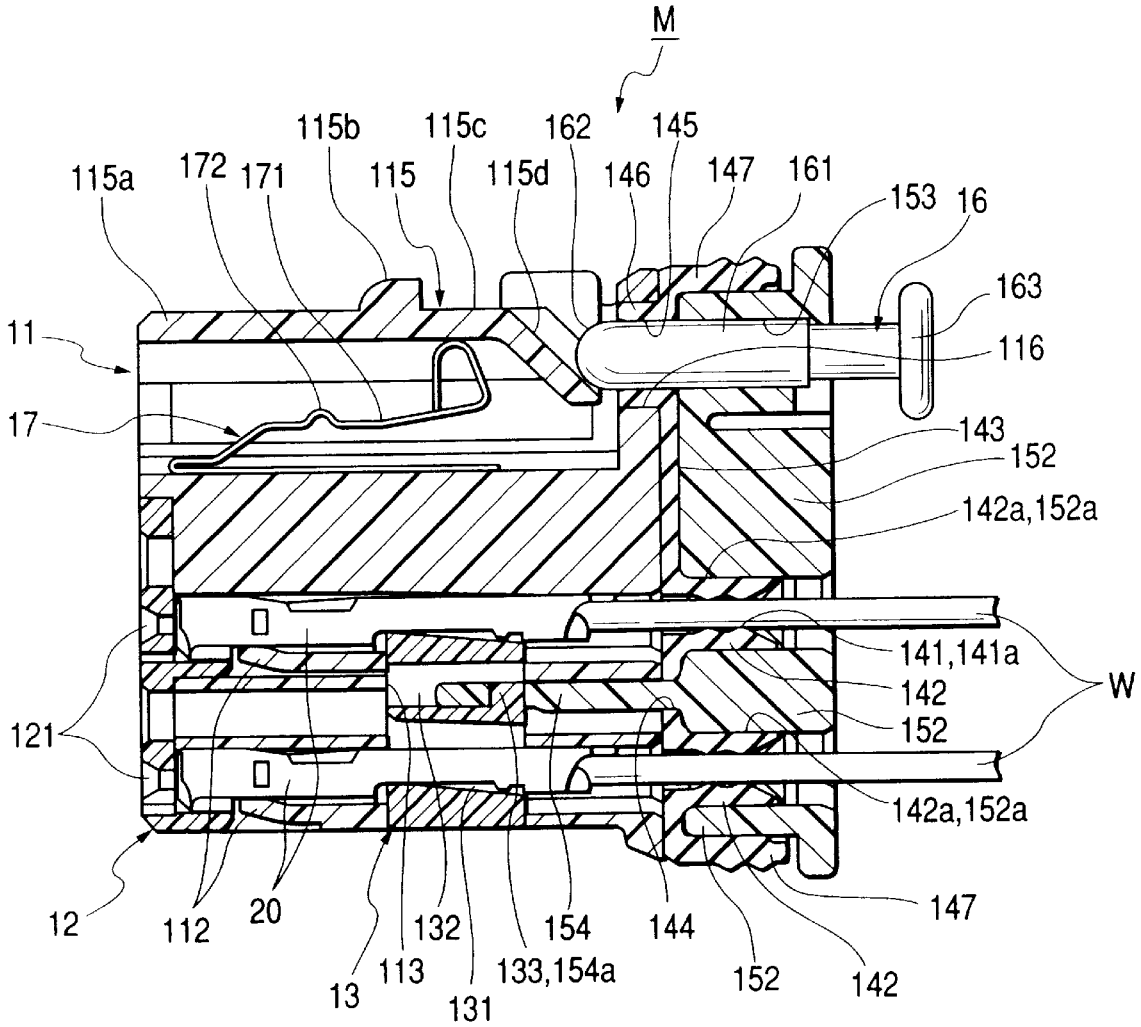
FIG. 9 is a cross-sectional side view of the next step following FIG. 8, and shows the waterproof connector after the assembly process has been completed.
Figure 10B:
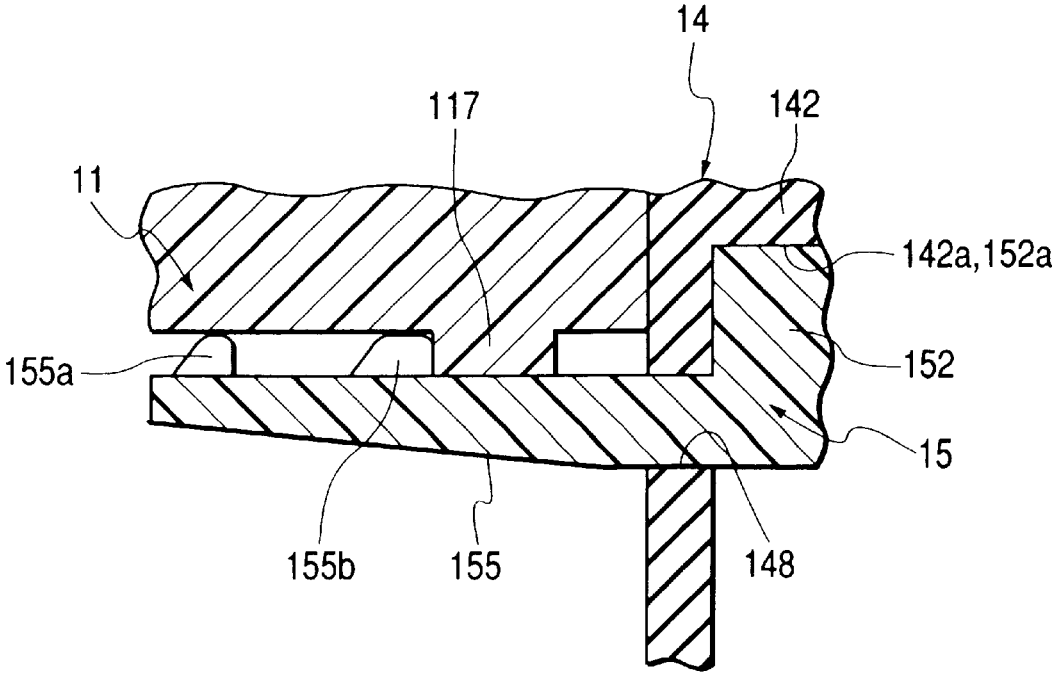
Figure 11A:
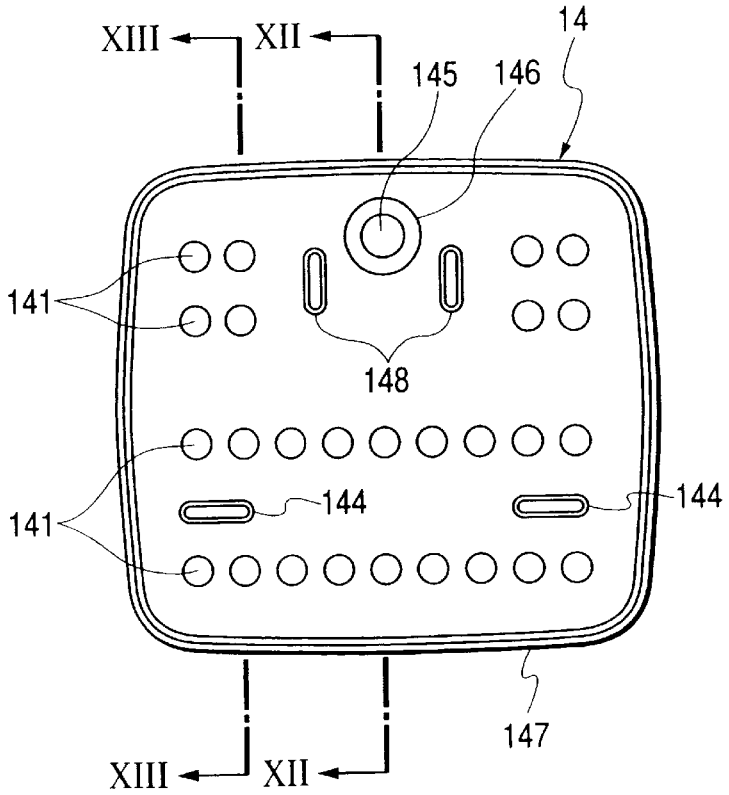
Figure 11B:
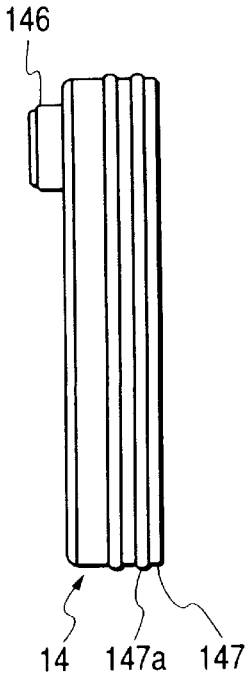

As is shown in FIG. 10B, when the second protrusion 155*a* is located in front of the protrusion 117, the rear holder 15 is securely held, and as is shown in FIGS. 8 and 9, the raised portion 152 has been fitted into the recessed portion 143 of the rubber plug 14.

The first protrusion 155*a*, the second protrusion 155*b* and the protrusion 117*c* constitute the means for temporarily holding the rear holder 15 on the connector housing 11. The second protrusion 155*b* and the protrusion 117 constitute one of the member for securely holding the rear holder 15 on the connector housing 11.

The assembly process for the waterproof connector M will now be explained.

As is shown in FIG. 2, first, the front cover 12 is mounted on the lower front face of the connector housing 11, and the spacer 13 is inserted from below into the spacer insertion recessed portion 113 that is formed in the lower face of the connector housing 11. At this time, the spacer 13 is held temporarily in the connector housing 11.

The rubber plug 14 is placed against the rear wall of the connector housing 11, and the cylindrical wall 146, which is projects outward around the unlock pin through hole 145 on the front face of the rubber plug 14, is fitted into the unlock pin through hole 116 that is formed in the connector housing 11.

Then, the rear holder 15 is positioned on the rear face of the rubber plug 14, and the lower and upper holding arms 154 and 155 of the rear holder 15 are respectively inserted via the through holes 144 and 148 in the rubber plug 14 into the insertion holes 114 and 118 in the connector housing 11.

As is shown in FIG. 10A, the upper holding arms 155 are inserted until they reach a position whereat the first protrusions 155*a* have passed the protrusion 117 on the connector housing 11 and the second protrusion 155*b* is held behind the protrusion 117. In this state, the rear holder 15 is temporarily held on the connector housing 1.

The unlock pin 16 is inserted via the through hole 153 in the rear holder 15, and into the through hole 145 in the cylindrical wall 146, which is fitted into the through hole 116 in the connector housing 11. This is the temporary assembled state shown in FIGS. 5 and 6.

Next, in the state wherein the rear holder 15 is held temporarily, as is shown in FIG. 7, the terminals 20 attached to the distal ends of the electric wires W are inserted via the insertion holes 151 in the rear holder 15 and the insertion holes 141 in the rubber plug 14 and are accommodated in the terminal chambers 111 in the connector 11. In the state where the rear holder 15 is held temporarily, the raised portion 152 of the rear holder 15 does not interfere with the cylindrical walls 142 of the insertion holes 141 in the rubber plug 14, i.e., the raised portion 152 is not fitted into the recessed portion 143 of the rubber plug 14 and pressure is not applied to the cylindrical walls 142. Thus, free expansion of the cylindrical walls 142 is permitted, so that the terminals 20 can be easily inserted.

When the terminals 20 are inserted into and retained by the terminal chambers 111 of the connector housing 11, the lances 112 are flexibly bent and recovered as the terminals 20 are passed.

As is shown in FIG. 8, the rear holder 15 is pushed and moved from the temporary holding position to the securely held position. Then, the raised portion 152 of the rear holder 15 is pushed in the recessed portion 143 of the rubber plug 14, and the squeezes 142*a* on the outer faces of the cylindrical walls 142 and the squeeze 147*b* on the inner face of the outer peripheral wall 147 are pressed by the wall 152*a* of the raised portion 152. Thus, since the compression force toward the diameter of the electric wire insertion holes 141 acts on the cylindrical walls 142, the cylindrical walls 142 closely contact the wires W, so that the portions that the electric wires W have penetrated are sealed. Further, the outer peripheral wall 147 can be backed up from the inner side. At the same time, as is shown in FIG. 10B, since the upper holding arms 155 of the rear holder 15 are moved forward, the second protrusion 155*b* is passed over the, protrusion 117 of the connector housing 11, and the rear holder 15 is securely held on the connector housing 11.

Further, since the unlock pin 16 is also inserted in the through hole 145 of the rubber plug 14, the other portions are securely sealed. In this case, the shaft 161 of the unlocking pin 16 is inserted into the through hole 145 of the rubber cap 14 that is fitted in the unlocking pin through hole 116 of the connector housing 11. Thus, the cylindrical wall 146 of the rubber cap 14 is compressed, and utilizing the generated reactive force, the cylindrical wall 146 brought more closely into contact with the connector housing 11 and the unlocking pin 16, thus ensuring that a strong seal is provided at this portion.

Finally, as is shown in FIG. 9, the spacer 13 is pushed up to securely lock the assembly. At this time, the protrusions 133 in the insertion holes 132 of the spacer 13 are inserted in the engagement holes 154*a* of the rear holder 15, so that the holding arms 154 are locked. Thus, the rear holder 15 is securely held by the lower and upper holding arms 154 and 155, and the assembly of the waterproof connector M is therefore complete.

For the thus arranged waterproof connector M, since the cylindrical walls 142 around the insertion holes 141 of the rubber plug can be freely expanded when the terminals 20 are to be inserted into the terminal chambers 111 of the connector housing 11, the insertion of the terminals 20 can be performed easily. Further, after the terminals have been inserted, the raised portion 152 of the rear holder is pressed into the recessed portion 143 of the rubber plug 14, and the cylindrical walls 142 are compressed and closely contact the outer faces of the electric wires W. In this manner, the highly sealed condition can be maintained.

Furthermore since the cylindrical walls 142 of the rubber plug 14 are not independently formed, but are united with several other walls to form blocks, unlike the related art, wherein a gap is ensured around the cylindrical walls 142 that permits them to be expanded, the pitch between the electric wire insertion holes 141 can be reduced.

With the waterproof plug 14 of this waterproof connector M, it is possible to increase the dimensional stability of the cylindrical wall 142 around the electric-wire insertion hole 141, the cylindrical wall 146 around the through hole 145 and the outer peripheral wall 147 that serves for sealing the waterproof connector by forming the annular convex portions 141*a*, 145*a* and 147*a* on only one face and the straight face on the other. Thus, high sealing performance can be demonstrated for certain.

A brief explanation will now be given, while referring to FIGS. 2 to 4, for the female connector F that engages the male connector M.

The connector housing 401 of the female connector F includes the hood 402 into which the male connector M is fitted. A protrusion 403 formed on the upper wall of the hood 402 engages the protrusion 115*b* of the lock arm 115 of the male connector M.

A rear wall 405 that the distal end of the male connector M contacts is formed in the connector housing 401. A normal male terminal 50 that is connected to the male terminal 20 projects linearly forward from the rear wall 405. From the top of the rear wall 405, the engagement detection terminal 450 projects linearly forward, as does the normal male terminal 50.

Since the force in the bending direction is exerted against the engagement detection terminal 450 when it contacts the short-circuit terminal 17 of the male connector M, the engagement detection terminal 450 is supported by a support wall 406, which projects forward above the terminal 450, that prevents the terminal 450 from being bent.

When the female connector F engages the male connector M, the inner face at the distal end of the hood 402 of the female connector housing 401 closely contacts the outer peripheral wall 147 of the rubber cap 14 that is located at the rear of the male connector. As a result, the waterproof space S is defined between the connectors M and F by the rubber cap 14. Since the junctures of the female terminal 20 and the male terminal 50, the lock arm 115, the engagement detection terminals 40 and 50 and the short-circuit terminal 17 are accommodated in the waterproof space S, water, mud and dust are prevented from entering these components from the outside.

As is shown in FIG. 2, when the male connector M normally engages the female connector F, the protrusion 115*b* on the lock arm 115 fully engages the protrusion 403 in the female connector housing 401, and the lock arm 115 is returned to its original position (it is not bent). Thus, the short-circuit terminal 17 contacts the engagement detection terminals 450, and a short circuit between the engagement terminals 450 is detected by an external circuit, thereby confirming the normal engagement of the connectors M and F.

Furthermore, as is shown in FIG. 4, when the male connector M temporarily engages the female connector F, the protrusion 115*b* on the lock arm impinges on the protrusion 403 on the female connector housing 401, and the lock arm 115 is bent downward from its original position. As a result, the spring piece 171 of the short-circuit terminal 17 is pushed and bent downward by the lock arm 115. Therefore, the contact point 172 and the engagement detection terminals 450 do not contact each other, and a short-circuit state between the engagement detection terminals 450 does not occur. Thus, the non-short-circuit state between the engagement detection terminals 450 can be detected by the external circuit, thereby confirming the half engagement state of the connectors M and F.

As is shown FIG. 3, in order to disengage the connectors M and F in the normal engagement state shown in FIG. 2, the operating portion 163 of the unlocking pin 16 that is projected to the rear end of the male connector M is pushed in the sliding direction. Then, the semi-spherical distal end 162 of the unlocking pin 16, which penetrates the rubber cap 14 and extends into the waterproof space S, contacts the inclined wall face of the unlocking portion 115*d* of the lock arm 115. When the unlocking pin 16 is pushed farther in, due to the action of the inclined face of the unlocking portion 115*d*, the lock arm 115 is bent downward, perpendicular to the direction in which the unlocking pin 16 slides. Therefore, when the connectors M and F are to be separated, since in this state the protrusion 115*b* is disengaged from the protrusion 403, accordingly, the connectors M and F are released. In this case, since the unlocking portion 115*d* is U-shaped in cross section, the distal end of the unlocking pin 16 always appropriately abuts upon the inclined rear wall of the unlocking portion 115*d*, and does not slide off the unlocking portion 115*d*.

Since the semi-spherical portion 162 is formed at the distal end of the shaft 161 of the unlocking pin 16, there is minimal contact between the distal end of the unlocking pin 16 and the unlocking portion 115*d*, and the sliding movement of the unlocking pin 16 can be precisely converted into the bending of the lock arm 115.

During the unlocking process, in response to the return of the lock arm 115 to its original position, the unlocking pin 16 is slid backward by the inclined unlocking portion 115*d*. Thus, a spring for returning the unlocking pin 16 to the original position is not required.

As is described above, the unlocking pin 16 need only slide in the direction in which it penetrates the rubber cap 14, so that the lock arm 115 can be released. Thus, a precise operation can be easily performed, and the entry of water via the portion whereat the unlocking pin 16 is inserted can be prevented. In addition, since the unlocking pin 16 must only be slid forward and backward, at the portion whereat the unlocking pin 16 is inserted, an excellent seal can be maintained. Especially since the cylindrical wall 146, which when compressed exerts increased contact force, is formed at the portion through which the unlocking pin 16 is inserted, a strong seal can be maintained.

The separate-type waterproof plug can be used for the above waterproof connector instead of the mat-type waterproof plug.

Figure 15:
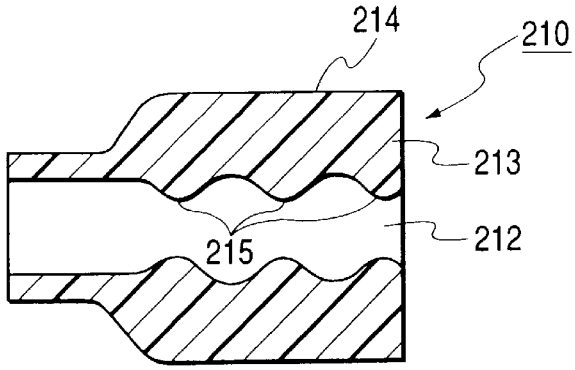
FIG. 15 is a sectional view showing a separate-type waterproof plug.

FIG. 15 is a sectional view of one example of a separate-type waterproof plug 210 according to the invention. The waterproof plug 210 has an insertion hole 212 for receiving an electric wire, and a cylindrical wall 213 surrounding the insertion hole 212. More specifically, the central hole is used as the electric-wire insertion hole 212, and the peripheral wall is used as the cylindrical wall 213 in order to form an independent substantially tubular body.

The waterproof plug 210 made of thermoplastic elastomeric resin is formed, by rapping molds with the direction of passing the: insertion hole 212 therethrough as a rapping direction. A plurality stages of annular convex portions 215 are also formed on only the inner peripheral face of the cylindrical wall 213 along a peripheral direction crossing the rapping direction, and the outer peripheral face thereof is formed as a straight face 214.

When the waterproof plug 210 is press-fitted in between the outer periphery of an electric wire and the inner periphery of the insertion hole of a connector housing, the annular convex portions 215 on the inner peripheral face are used to make the straight face 214 of the outer periphery stick fast to the inner peripheral wall of the insertion hole of the connector housing as the curved portions are compressed in order to increase the adhesion to the electric wire as well in the related art.

When the waterproof plug 210 is formed by molding, there are used a stationary mold 221 for mainly molding the outer peripheral face and a moving mold 222 for mainly molding the inner peripheral face as shown in FIG. 16. The stationary mold 221 is provided with a recessed molding face 21*a* for forming the outer peripheral shape of the waterproof plug 210. The moving mold 222 is provided with a projected molding rod 223 for forming the inner peripheral shape of the waterproof plug 210. The molding face 223*a* has a corrugated configuration for forming the inner peripheral shape of the annular convex portions 215.

The moving mold 222 is provided with a first moving mold 222*a* on the back side and a second moving mold 222*b* on the front side the second moving mold 222*b* being longitudinally movable relative to the first moving mold 222*a*. The molding rod 223 is projected from the first moving mold 222*a* on the back side and its front end portion is projected forward from the opening 222*c* of the second moving mold 222*b*. The second moving mold 222*b* is provided with an extrusion rod 225 for forcing the second moving mold 222*b* forward from the first, moving mold 222*a*.

Figure 16A:
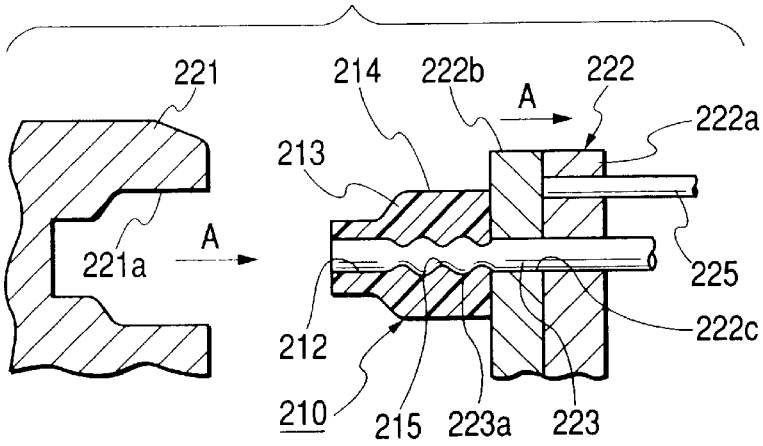
FIGS. 16A and 16B are explanatory diagrams for explaining a rapping method after the waterproof plug of FIG. 15 is molded referring to the first stage and the second stage, respectively.

The stationary mold 221 and the moving mold 222 are clamped together and thermoplastic elastomeric resin is injected to mold the waterproof plug 210. Then the moving mold 222 is opened in the direction of an arrow A as shown in FIG. 16A.

At this time, the outer peripheral face of the cylindrical wall 213 of the waterproof plug 210 is the straight face 214, whereas the inner peripheral face thereof is formed with the annular convex portions 215 forming an uneven face, whereby the waterproof plug 210 is drawn out of the stationary mold 221 without any excessive force applied thereto before being left on the side of the moving mold 222.

Figure 16B:
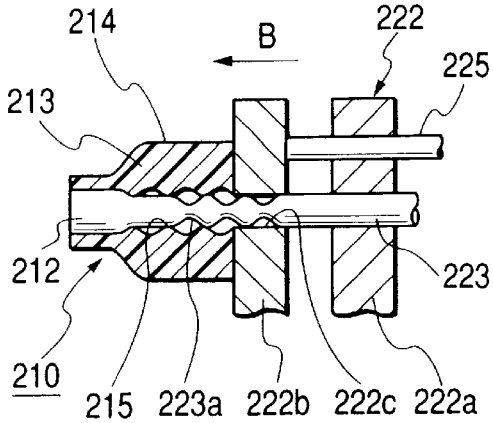

As shown in FIG. 16B, the waterproof plug 210 held on the outer periphery of the front end portion of the molding rod 223 is pulled down from the molding rod 223 by using the extrusion rod 225 to force the second moving mold 222*b* forward in the direction of an arrow B. The waterproof plug 210 thus produced is obtainable.

In the above process of production, since the waterproof plug 210 is drawn along the straight face 214 when the waterproof plug 210 is drawn from the stationary mold 221 at the first stage, no excessive force becomes applied to the waterproof plug 210. When the waterproof plug 210 is drawn from the moving mold 222 equipped with the molding rod 223 at the second stage, moreover, its opposed outer peripheral face has already been released with the effect of allowing free deformation, whereby no excessive force also becomes applied to the waterproof plug 210 because of drawing.

In other words, no excessive force becomes applied to the waterproof plug 210 even when not only the outer peripheral face but also the inner peripheral face is drawn and because plastic deformation is preventable even in a case where thermoplastic elastomeric resin having a lower elastic stress marginal value is employed, dimensional stability can be increased.

Another example of the separate-type waterproof plug according to the invention will be described.

Figure 17:
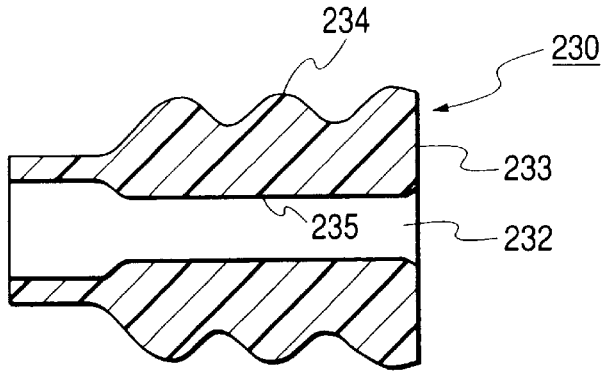
FIG. 17 is a sectional view showing another separate-type waterproof plug.

FIG. 17 is a sectional view of a separate-type waterproof plug 230 according to the second embodiment of the invention. The waterproof plug 230 has an insertion hole 232 for receiving an electric wire, and a cylindrical wall 233 surrounding the insertion hole 232. More specifically, the central hole is used as the insertion hole 232, and the peripheral wall is used as the cylindrical wall 233 in order to form an independent substantially tubular body.

The waterproof plug 230 made of thermoplastic elastomeric resin is formed by rapping molds with the direction of passing the electric-wire insertion hole 232 therethrough as a rapping direction. A plurality of stages of annular convex portions 234 are also formed on only the outer peripheral face of the cylindrical wall 233 along a peripheral direction crossing the rapping direction, and the inner peripheral face thereof is formed as a straight face 235.

When the waterproof plug 230 is press fitted in between the outer periphery of the electric wire and the inner periphery of the insertion hole of the connector housing, the annular convex portions 234 on the outer peripheral face are used to make the straight face 235 of the inner periphery stick fast to the outer periphery of the electric wire as the curved portions are compressed in order to increase the adhesion to the electric wire as before.

When the waterproof plug 230 is formed by molds, there are used a stationary mold 241 for mainly molding the inner peripheral face and a moving mold 242 for mainly molding the outer peripheral face as shown in FIG. 18. The stationary mold 241 is provided with a projected molding rod 243 for forming the inner peripheral shape of the waterproof plug 230. The moving mold 242 is provided with a recessed molding face 242*a* for forming the outer peripheral shape of the waterproof plug 230. The molding face 242*a* has a corrugated configuration for forming the outer peripheral shape of the annular convex portions 234. Further, the moving mold 242 is provided with an extrusion rod 244 so that the waterproof plug 230 left in the moving mold 242 may be forced out.

Figure 18A:
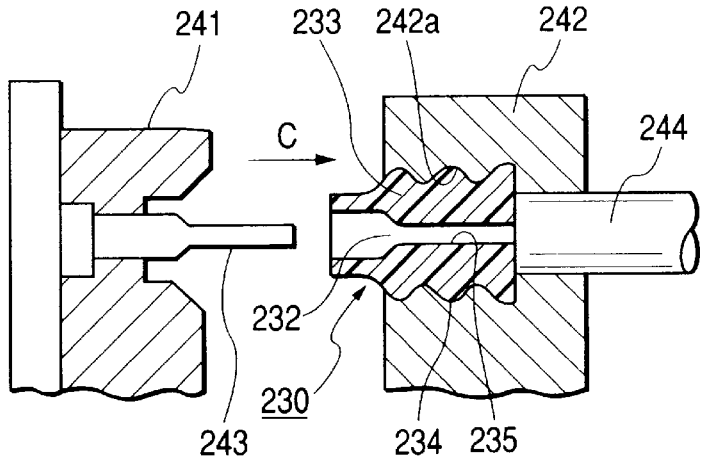
FIGS. 18A and 18B are explanatory diagrams for explaining a rapping method after the waterproof plug of FIG. 17 is molded referring to the first stage and the second stage, respectively.

The stationary mold 241 and the moving mold 242 are clamped together and thermoplastic elastomeric resin is injected to mold the waterproof plug 230. Then the moving mold 242 is opened in the direction of an arrow C as shown in FIG. 18A.

Figure 18B:
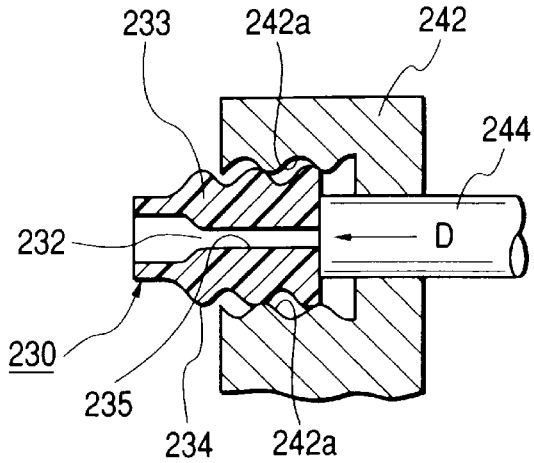
Figure 19:
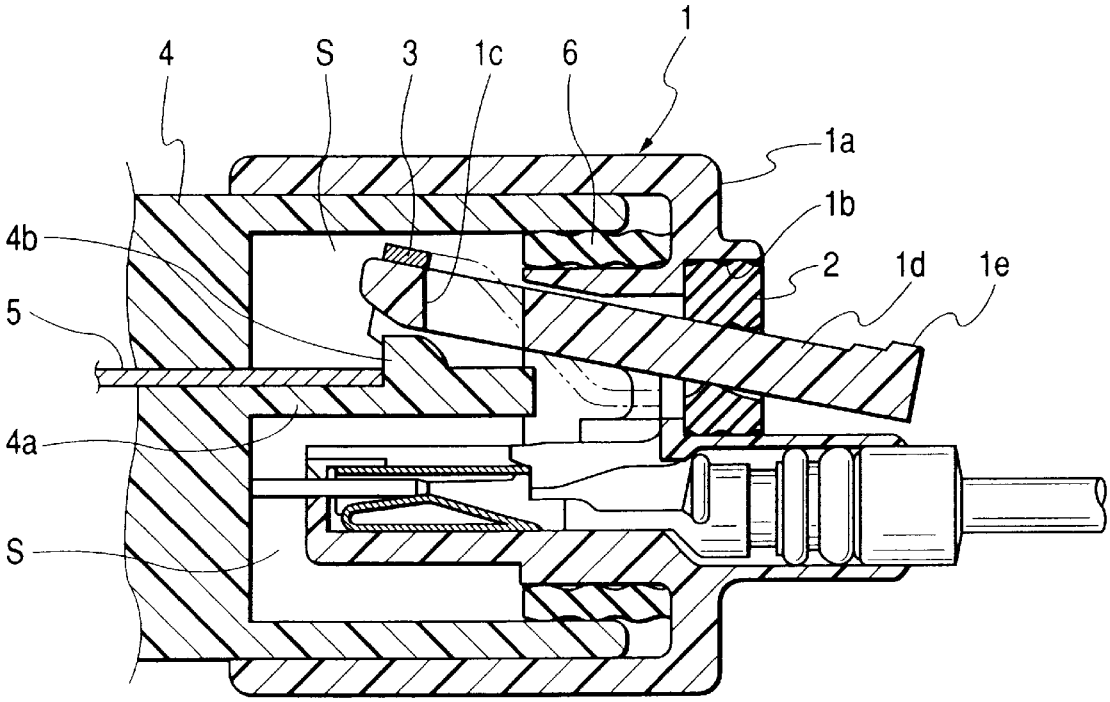
FIG. 19 is a cross-sectional view showing a related waterproof. connector.
Figure 20:
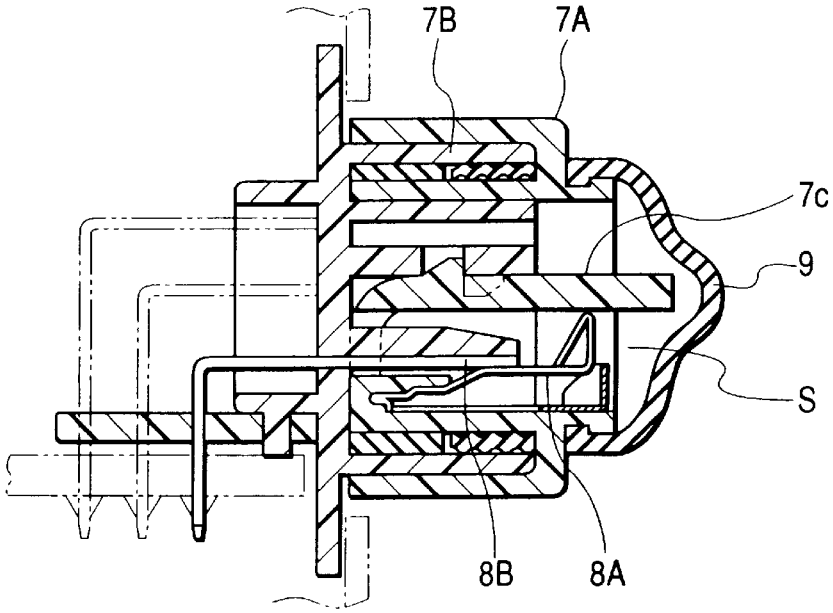
FIG. 20 is a cross-sectional view showing another related waterproof connector.
Figure 21:
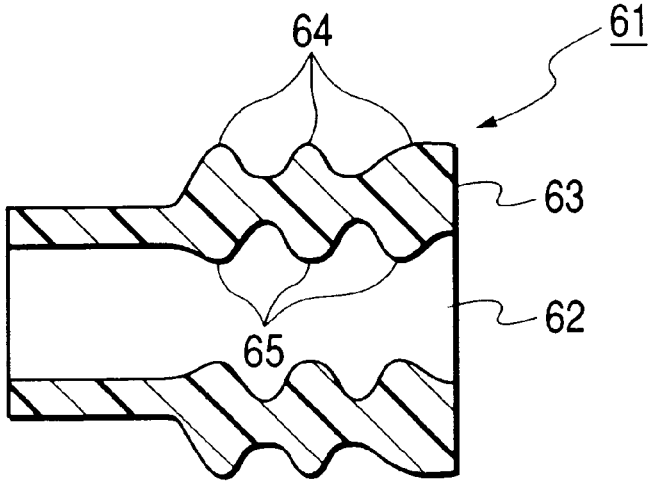
FIG. 21 is a sectional view showing a related waterproof plug.
Figure 22:
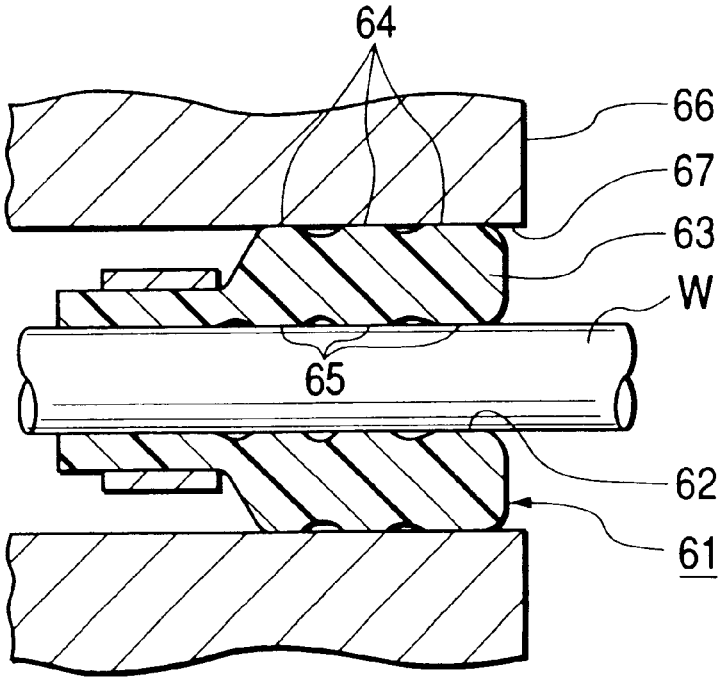
FIG. 22 is a sectional view showing a state that the related waterproof plug showing is fitted into a connector housing.
Figure 23:
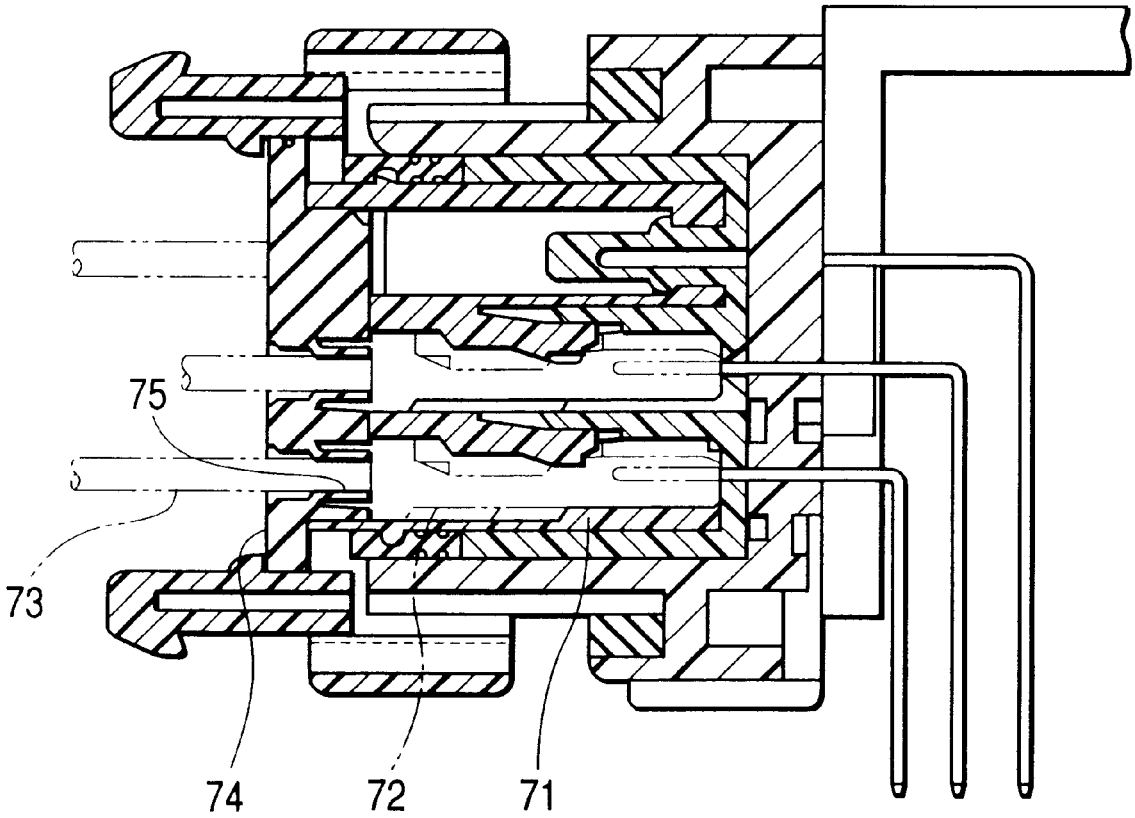
FIG. 23 is a cross-sectional view of a related waterproof connector.
Figure 24A:
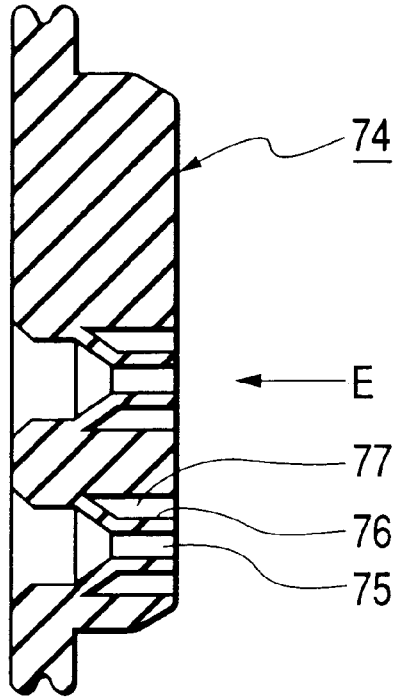
Figure 24B:
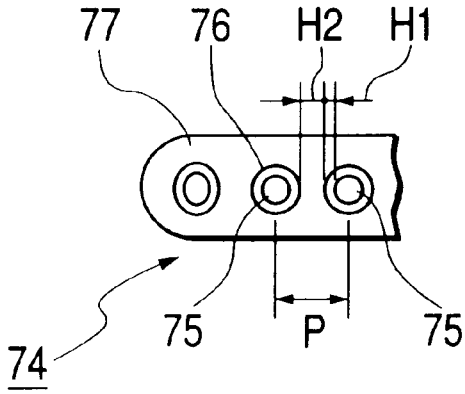

At this time, the inner peripheral face of the cylindrical wall 233 of the waterproof plug 230 is the straight face 235, whereas the outer peripheral face thereof is formed with the annular convex portions 234 forming an uneven face, whereby the waterproof plug 230 is drawn out of the stationary mold 241 without any excessive force applied thereto before being left on the side of the moving As shown in FIG. 18B, the waterproof plug 230 is pulled down by forcing out the waterproof plug 230 left in the moving mold 242 forward in the direction of an arrow D by the extrusion rod 244. The waterproof plug 230 thus produced is obtainable.

In the above process of production, since the waterproof plug 230 is drawn along the straight face 235 when the waterproof plug 230 is drawn from the stationary mold 241 at the first stage, no excessive force becomes applied to the waterproof plug 230. When the waterproof plug 230 is drawn from the moving mold 242 at the second stage, moreover, its opposed inner peripheral face has already been released with the effect of allowing free deformation, whereby no excessive force also becomes applied to the waterproof plug 230 because of drawing.

In other words, no excessive force becomes applied to the waterproof plug 230 even when not only the inner peripheral face but also the outer peripheral face is drawn and because plastic deformation is preventable even in a case where thermoplastic elastomeric resin having a lower elastic stress marginal value is employed, dimensional stability can be increased.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. A waterproof connector comprising:

a pair of connector housings to be engaged with each other;

a lock member for locking the connector housings at a position where the connector housings are completely engaged;

a seal member for defining a waterproof space which accommodates the lock member, the seal member having a through hole which communicates inside and out of the waterproof space; and an unlock member sealedly inserted into the through hole so as to be slidable in an insertion direction thereof to unlock the engagement of the housing.

2. The waterproof connector as set forth in claim 1 wherein one of the connector housings includes a guide member situated adjacent to the seal member for guiding the slide movement of the unlock member; and wherein the seal member is made of a material harder than that of the seal member.

3. The waterproof connector as set forth in claim 1, wherein one of the connector housings includes a through hole situated adjacent to the seal member;

wherein the seal member includes a cylindrical wall portion surrounding the through hole and fitted with the through hole of the connector housing; and wherein the cylindrical wall portion is compressed between an outer periphery of the unlock member and an inner wall of the through hole of the connector housing.

4. The waterproof connector as set forth in claim 1, further comprising a terminal for electrically detecting the engagement condition of the connector housings, which is disposed inside of the waterproof space.

5. The waterproof connector as set forth in claim 1, wherein the lock member is a lock arm provided with one of the connector housings, which is flexible between a first position for locking the engagement of the connector housings and a second position for unlocking the engagement; and wherein the unlock member slides in the through hole toward inside of the waterproof space to flex the lock arm towards the second position.

6. The waterproof connector as set forth in claim 5, wherein the sliding direction of the unlock member and the flexing direction of the lock arm is substantially orthogonal; and wherein the lock arm is provided with a slant face for converting the sliding movement of the unlock member into the flexing movement of the lock arm, and converting a restoring movement of the lock arm into a slide-back movement of the unlock member.

7. The waterproof connector as set forth in claim 6, wherein a distal end of the unlock member, which abuts against the slant face of the lock arm, is rounded.

8. The waterproof connector as set forth in claim 7, wherein the slant face includes a groove portion for receiving the distal end of the unlock member.

9. A waterproof connector comprising:

connector housing including a plurality of terminal chambers into for respectively accommodating a terminal provided with an electric wire;

a mat-shaped rubber plug attached to a rear end portion of the connector housing, in which recessed portions are formed such that cylindrical portions each having a through hole therein, through which the electric wire is inserted, are protruded therefrom; and a rear holder attached to the rear end portion of the connector housing to retain the rubber plug thereat, the rear holder including projections each configured so as to compress an outer periphery of the associated cylindrical portion of the rubber plug in the diameter direction of the electric wire as being inserted into the associated recessed portion of the rubber plug.

10. The waterproof connector as set forth in claim 9, further comprising:

a provisional retaining member for provisionally retaining the rear holder onto the connector housing such that the projections of the rear holder do not interfere with the associated cylindrical portions of the rubber plug; and a retaining member for securely retaining the rear holder onto the connector housing such that the projections compress the associated cylindrical portions.

11. The waterproof connector as set forth in claim 9, wherein the rubber plug includes at least one protrusion block formed by integrating adjacent cylindrical portions.

* * * * *